US007385579B2

(12) United States Patent
Satake

(10) Patent No.: US 7,385,579 B2
(45) Date of Patent: Jun. 10, 2008

(54) LIQUID CRYSTAL DISPLAY DEVICE AND METHOD OF DRIVING THE SAME

(75) Inventor: Rumo Satake, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 551 days.

(21) Appl. No.: 09/966,354

(22) Filed: Sep. 27, 2001

(65) Prior Publication Data

US 2002/0075216 A1 Jun. 20, 2002

(30) Foreign Application Priority Data

Sep. 29, 2000 (JP) ..... 2000-300754

(51) Int. Cl.
*G09G 3/36* (2006.01)

(52) U.S. Cl. ..... 345/88; 345/89; 345/90; 345/97; 345/98

(58) Field of Classification Search ..... 345/88, 345/87, 90, 92, 97, 98, 100, 85, 89, 692, 345/55; 349/49, 87, 129, 48, 34; 359/15; 313/493

See application file for complete search history.

(56) References Cited

U.S. PATENT DOCUMENTS 4,090,219 A 5/1978 Ernstoff et al.
4,750,813 A 6/1988 Ohwada et al.
4,907,862 A 3/1990 Suntola
5,233,447 A * 8/1993 Kuribayashi et al. ..... 345/97
5,327,229 A 7/1994 Konno et al.
5,428,366 A 6/1995 Eichenlaub
5,465,168 A * 11/1995 Koden et al. ..... 349/33
5,473,449 A * 12/1995 Takemura et al. ..... 349/49
5,528,262 A 6/1996 McDowall et al.
5,594,569 A 1/1997 Konuma et al.
5,608,558 A * 3/1997 Katsumi ..... 349/192
5,615,027 A * 3/1997 Kuribayashi et al. ..... 349/87
5,642,129 A 6/1997 Zavracky et al.
5,643,826 A 7/1997 Ohtani et al.
5,691,783 A * 11/1997 Numao et al. ..... 349/48
5,774,100 A * 6/1998 Aoki et al. ..... 345/87
5,844,533 A * 12/1998 Usui et al. ..... 345/89
5,923,962 A 7/1999 Ohtani et al.
5,969,832 A * 10/1999 Nakanishi et al. ..... 359/15
6,046,716 A * 4/2000 McKnight ..... 345/95
6,078,304 A 6/2000 Miyazawa (Continued)

OTHER PUBLICATIONS

"Field Sequential Color LCD by Ferroelectric Liquid Crystal," Press Journal, Monthly FPD Intelligence, Feb. 1, 1999, pp. 66-69, with English translation.

(Continued)

*Primary Examiner*—Prabodh Dharia
(74) *Attorney, Agent, or Firm*—Fish & Richardson P.C.

(57) ABSTRACT

A signal of a signal line is written in the order from a pixel TFT of a pixel with a long response time of liquid crystal. A signal of a signal line is written in a pixel TFT displaying the same gray-scale among pixel TFTs connected to the same signal line. A signal of a signal line is simultaneously written in pixel TFTs displaying the same or approximate gray-scale among pixel TFTs connected to the same signal line. Then, a pixel electrode of a pixel TFT displaying an approximate gray-scale is supplied with a normal signal voltage.

19 Claims, 14 Drawing Sheets

U.S. PATENT DOCUMENTS

| | | | | |
|---|---|---|---|---|
| 6,166,714 | A * | 12/2000 | Kishimoto | 345/96 |
| 6,177,920 | B1 * | 1/2001 | Koyama et al. | 345/100 |
| 6,188,379 | B1 | 2/2001 | Kaneko | |
| 6,222,515 | B1 * | 4/2001 | Yamaguchi et al. | 345/89 |
| 6,300,927 | B1 | 10/2001 | Kubota et al. | |
| 6,320,568 | B1 | 11/2001 | Zavracky | |
| 6,344,889 | B1 * | 2/2002 | Hasegawa et al. | 349/129 |
| 6,424,331 | B1 * | 7/2002 | Ozawa | 345/98 |
| 6,473,117 | B1 * | 10/2002 | Iba | 348/87 |
| 6,486,864 | B1 * | 11/2002 | Nakajima et al. | 345/100 |
| 6,512,503 | B1 * | 1/2003 | Kim et al. | 345/87 |
| 6,522,319 | B1 * | 2/2003 | Yamazaki | 345/103 |
| 6,545,653 | B1 * | 4/2003 | Takahara et al. | 345/87 |
| 6,671,009 | B1 * | 12/2003 | Hattori et al. | 349/33 |
| 6,727,875 | B1 * | 4/2004 | Mikami et al. | 345/92 |
| 6,967,637 | B2 * | 11/2005 | Aoyama et al. | 345/94 |
| 6,980,190 | B2 * | 12/2005 | Ueda | 345/96 |
| 6,992,649 | B2 * | 1/2006 | Iba | 345/89 |
| 7,123,225 | B2 * | 10/2006 | Chen | 345/89 |
| 7,233,342 | B1 * | 6/2007 | Yamazaki et al. | 345/692 |
| 2001/0011979 | A1 * | 8/2001 | Hasegawa et al. | 345/87 |
| 2001/0017610 | A1 * | 8/2001 | Ozawa | 345/100 |
| 2001/0043177 | A1 * | 11/2001 | Huston et al. | 345/87 |
| 2002/0024621 | A1 * | 2/2002 | Hirakata et al. | 349/34 |
| 2002/0158568 | A1 * | 10/2002 | Satake | 313/493 |
| 2003/0006954 | A1 * | 1/2003 | Iba | 345/90 |
| 2003/0043093 | A1 * | 3/2003 | Bolotski et al. | 345/87 |
| 2003/0058210 | A1 | 3/2003 | Yamazaki et al. | |
| 2004/0135756 | A1 * | 7/2004 | Mikami et al. | 345/92 |
| 2004/0145552 | A1 * | 7/2004 | Song et al. | 345/87 |
| 2005/0030258 | A1 * | 2/2005 | Satake | 345/55 |

OTHER PUBLICATIONS

S. Kobayashi, "Color Liquid Crystal Display," Display Technology Series, Industrial Books, p. 127, with English translation.

"Field Sequential Color LCD by Ferroelectric Liquid Crystal," Press Journal, Monthly FPD Intelligence, Feb. 1, 1999, pp. 66-69, with English translation.

S. Kobayashi, "Color Liquid Crystal Display," Display Technology Series, Industrial Books, p. 127, with partial English translation, Dec. 14, 1990.

* cited by examiner

LIQUID CRYSTAL DISPLAY DEVICE AND METHOD OF DRIVING THE SAME

BACKGROUND OF THE INVENTION

1. Field of the Invention

The present invention relates to a liquid crystal display device and a method of driving the same. A liquid crystal display device conducts a light and dark display by utilizing a voltage applied to a liquid crystal layer interposed between substrates to change a polarized state, a scattered state, or wavelength characteristics of light passing through the liquid crystal layer.

In the present specification, a thin film transistor (TFT) refers to a semiconductor device having a semiconductor layer, a gate electrode, a source electrode, and a drain electrode.

2. Description of the Related Art

Liquid crystal display devices have been used widely for portable equipment, personal computers, and the like in view of their light weight and low power consumption.

In a liquid crystal display device, a field sequential system has been paid attention to, in which light sources of three primary colors (red, green, and blue) are successively lighted to conduct a color display. The field sequential system does not need a color filter, so a high-precision display can be expected.

Regarding the field sequential system, it is proposed that light sources are successively and continuously lighted with varying light emission colors (Monthly FPD Intelligence Press Journal, 1999. 2, pp. 66-69). According to this system, when light emission colors of the light sources are changed, it is required to set the entire screen at a black level so as to prevent mixed color of the light sources in the respective pixels.

It is also proposed that a light source is lighted after response of liquid crystal is completed in a screen (Shunsuke Kobayashi, Color Liquid Crystal Display, Sangyo Tosho, Japan, p. 127). According to this system, light sources are intermittently lighted, so that a complete black display can be achieved when the light sources are not lighted. This allows an impulse system that is a driving system of a cathode ray tube (CRT) to be achieved even in a liquid crystal display device, and this system can be expected to prevent a residual image peculiar to a liquid crystal display device.

The problems to be solved by the invention will be described below.

Note that, in the present specification, a TFT formed in a pixel portion is referred to as a "pixel TFT".

Furthermore, in the present specification, signal lines having addresses $S_1$ to $S_m$, scanning lines having addresses $G_1$ to $G_n$, and pixels disposed in the vicinity of crossing points between the signal lines and the scanning lines are formed in pixel portions. Each pixel has a pixel TFT. A gate electrode of the pixel TFT is connected to a scanning line, and a source electrode thereof is connected to a signal line. The address of each pixel is represented by an address of a signal line connected to a source electrode of a pixel TFT, and an address of a scanning line connected to a gate electrode thereof. For example, when a pixel TFT is connected to a signal line in an i-th column and a scanning line in a j-th row, the address of a pixel having this pixel TFT is (i, j).

Furthermore, a pixel electrode is formed so as to be connected to a drain electrode of a pixel TFT, and an opposing electrode is opposed to the pixel electrode. Liquid crystal is interposed between the pixel electrode and the opposing electrode via an alignment film. Liquid crystal is switched in accordance with a potential difference between the pixel electrode and the counter electrode.

In dot-sequential driving, a period from a time when a first scanning line is selected to a time when an n-th scanning line is selected is referred to as a "scanning period of scanning lines". Applying a predetermined potential (e.g., +8 volts to +11 volts) to a scanning line for the purpose of activating a semiconductor layer is referred to as "selecting a scanning line". A period for selecting a scanning line is referred to as a "scanning line selection period".

More specifically, the "scanning period of scanning lines" refers to a period required from the beginning of selection of a first scanning line to the end of selection of an n-th scanning line. "Selecting a scanning line" refers to applying a gate pulse to a pixel TFT connected to a scanning line, thereby bringing a conducting state between a source and a drain of the pixel TFT connected to the scanning line. Furthermore, a selection period of a scanning line refers to a period for selecting one scanning line, and the "scanning period of scanning lines" is obtained by multiplying the selection period of a scanning line by n times.

Furthermore, selecting a signal line refers to applying a signal voltage to a signal line, and applying a potential of the signal line to a pixel TFT connected to the signal line.

Furthermore, a period from a time when a potential required for an image display is applied to a pixel electrode of a pixel TFT having an address (1,1) to a time when one monochromic image is formed is referred to as a "sub-frame period". A period from a time when a potential required for an image display is applied to a pixel electrode of a pixel TFT having an address (1,1) to a time when one color image is formed is referred to as a "frame period".

According to the field sequential system, a frame period in which a color image is displayed includes a sub-frame period for forming a red image, a sub-frame period for forming a blue image, and a sub-frame period for forming a green image.

FIG. 7 shows a timing chart of the field sequential system in which light sources are lighted intermittently. According to the field sequential system, a cycle (T) of one frame period is 16.6 msec., and a cycle (T/3) of a sub-frame period is 5.5 msec.

In dot-sequential driving, one scanning line is selected, and signal lines are successively selected by a shift register of a source driver, to thereby apply a potential of a signal line to a pixel electrode of each pixel TFT connected to a selected scanning line. The sub-frame period is divided into a standby period 301, a scanning line selection period 302, a liquid crystal response period 303, and a lighting period 304 of light sources. The standby period refers to a period from a time when one frame period starts to a time when a scanning line connected a pixel TFT is selected. The liquid crystal response period refers to a period in which liquid crystal responses in accordance with a potential of a pixel electrode. A scanning period 308 of scanning lines is obtained by multiplying a scanning line selection period by the number (n) of scanning lines.

In the scanning line selection period 302, a scanning line is selected, and a pixel electrode of a pixel TFT connected to the scanning line is successively supplied with a potential of a signal line in accordance with a desired gray-scale. In the liquid crystal response period 303, optical response of liquid crystal is completed. In the lighting period 304 of light sources, light sources are lighted intermittently, whereby a first light emission color 305, a second light emission color 306, and a third light emission color 307 are successively entered into a liquid crystal display device. For example, as the first light emission color, a red color is used. As the second light emission color, a green light is used. As the third light emission color, a blue light is used. However, when the light sources are lighted intermittently, the liquid crystal response period 303 of the pixel TFTs connected to a first scanning line is different from that of the pixel TFTs connected to an n-th scanning line. When it takes a long period of time for liquid crystal to respond, or when the scanning period 308 of scanning lines is long, if it is attempted to light a light source after liquid crystal response is completed, the lighting period 304 of light sources becomes short, which decreases lightness.

According to the field sequential system, one important factor is a response time of liquid crystal. As the response time of liquid crystal becomes shorter, a lighting period of a light source can be made longer to conduct a light display.

Another important factor of the field sequential system is a scanning period of scanning lines. Assuming that there are n scanning lines, when a scanning period becomes longer, it takes a shorter period of time for a light source to be lighted after the application of a potential of a signal line to a pixel electrode toward the n-th scanning line. Therefore, before response of liquid crystal is completed, a light source is lighted. A gray-scale level is determined by the integral of lightness shown by liquid crystal when a light source is lighted. If a light source is lighted before response of liquid crystal is completed, a gray-scale level when a screen is displayed is changed. On the contrary, if a light source is lighted after response of liquid crystal is completed, a lighting period of a light source becomes shorter, which results in a dark display.

In liquid crystal display devices with a number of scanning lines, e.g., XGA (1024 pixels (horizontal direction)× 768 pixels (vertical direction)), SXGA (1280 pixels (horizontal direction)×1024 pixels (vertical direction), the ratio of a scanning period of scanning lines in a sub-frame period is not negligible. In dot-sequential driving of the SXGA liquid crystal display device, even if a write time of a signal to one pixel is set to be 0.75 to 1.5 nsec, a scanning period of scanning lines is estimated to be 1 to 2 msec. Therefore, when a scanning period of scanning lines is removed from a sub-frame period (5.5 msec), only 3.5 to 4.5 msec remains. If liquid crystal is allowed to respond until desired lightness is obtained and a light source is lighted within this time, a lighting time of a light source becomes considerably short, making it difficult to conduct a light display.

In the present specification, optical response of liquid crystal is allowed to be completed as early as possible in driving of a liquid crystal display device of the field sequential system. Furthermore, a scanning period of scanning lines is shortened to decrease a ratio of a standby period 301 in a sub-frame period.

More specifically, in the present specification, in the field sequential system, a sum of a standby period 301 and a liquid crystal response period 303 is shortened, and a lighting period 304 of a light source is prolonged, whereby a light display is conducted.

SUMMARY OF THE INVENTION

The present invention is characterized in that, when a pixel electrode having a potential of a first signal voltage in a first sub-frame period has a potential of a second signal voltage in a second sub-frame period, a response time of liquid crystal when a voltage value is changed from the first signal voltage to the second signal voltage is calculated, and in an order from a pixel in which the calculated response time of liquid crystal is long, the potential of the second signal voltage is applied to the pixel electrode of the pixel in the second sub-frame period.

According to the present invention, a circuit configuration includes: a first means for storing a potential of a first signal voltage applied to a pixel electrode in a first sub-frame period; a second means for storing a potential of a second signal voltage applied to the pixel electrode in a second sub-frame period; a third means for calculating a response time of liquid crystal when a voltage value is changed from the first signal voltage to the second signal voltage; and a fourth means for applying, in an order from a pixel in which the calculated response time of liquid crystal is long, the second signal voltage to the pixel electrode of the pixel.

According to the field sequential system, there are a sub-frame period in which a monochromic image is formed, and a frame period in which three sub-frame periods are continuously combined to form a color image. The above-mentioned configuration is applicable to the field sequential system. Furthermore, by replacing the sub-frame period with the frame period, the present invention can be applied widely to a liquid crystal display device and a method of driving the same irrespective of the field sequential system.

In dot-sequential driving, pixels are successively selected from pixel electrodes connected to pixel TFTs connected to a scanning line in a first row to pixel electrodes having pixel TFTs connected to a scanning line in an n-th row. Therefore, when a response time of liquid crystal is long in pixels connected to a scanning line in the n-th row, liquid crystal may not respond by the time when light sources are lighted in the field sequential system. However, according to the present invention, when an image is changed from a first sub-frame period to a second sub-frame period, and liquid crystal responds, a pixel having a long response time of liquid crystal is preferentially selected. Therefore, in a timing chart of the field sequential system in FIG. 7, a standby period 301 becomes short in a pixel having a long response period 303 of liquid crystal, and the sum of the standby period 301 and the liquid crystal response period 303 can be shortened. More specifically, a lighting period 304 of a light source can be prolonged, making it possible to conduct a light display.

Furthermore, the present invention is characterized in that a potential of the same signal voltage is simultaneously applied to pixel electrodes of a plurality of pixels connected to the same signal line and displaying the same gray-scale. By simultaneously selecting a plurality of pixels, a scanning period of scanning lines can be shortened.

Furthermore, the present invention has a first stage in which a potential of a first signal voltage is applied to a first pixel electrode connected to a first pixel TFT connected to a signal line and a first scanning line and a second pixel electrode connected to a second pixel TFT connected to the signal line and a second scanning line.

The present invention also has a second stage in which the signal line and the second scanning line are selected and the second pixel electrode is supplied with a potential of a second signal voltage whose difference in an absolute value from that of the first signal voltage is larger than 0 volt and smaller than 0.5 volt.

Thus, in the first stage, a potential of a first signal voltage is applied to a second pixel electrode connected to a drain electrode of a second pixel TFT, thereby previously allowing liquid crystal to respond. It is assumed that the second pixel electrode is a pixel electrode displaying a gray-scale approximate to that of the first pixel electrode. The approximate gray-scale refers to a gray-scale displayed with an absolute value of a voltage whose difference from that of a voltage applied to the first pixel electrode is larger than 0 volt and smaller than 0.5 volt. In the second stage, a second signal voltage is applied to a second pixel electrode, thereby allowing liquid crystal to respond so as to display a normal gray-scale. By previously allowing liquid crystal to respond, when a potential of a second signal voltage is applied to a second pixel electrode, a response time required for responding to a gray-scale of a display image can be shortened.

In order to prevent burning of liquid crystal, a first pixel TFT and a second pixel TFT in which a signal of a signal line is simultaneously written may be made pixel TFTs in which a voltage with the same polarity is to be written.

Each invention as described above can be widely used as a liquid crystal display device and a method of driving the same. In particular, each invention is effective for the field sequential system in which light sources are intermittently lighted for the following reason. Light sources are intermittently lighted. Therefore, even when the order of writing signal voltages in pixels is at random, light sources are not lighted while signal voltages are written in pixels and random write is not visually recognized by a user.

A combination of the above-mentioned inventions would be widely applied to a known method of driving liquid crystal, as well as the field sequential system.

DETAILED DESCRIPTION OF THE PREFERRED EMBODIMENTS

Embodiment Mode 1

Figure 1:
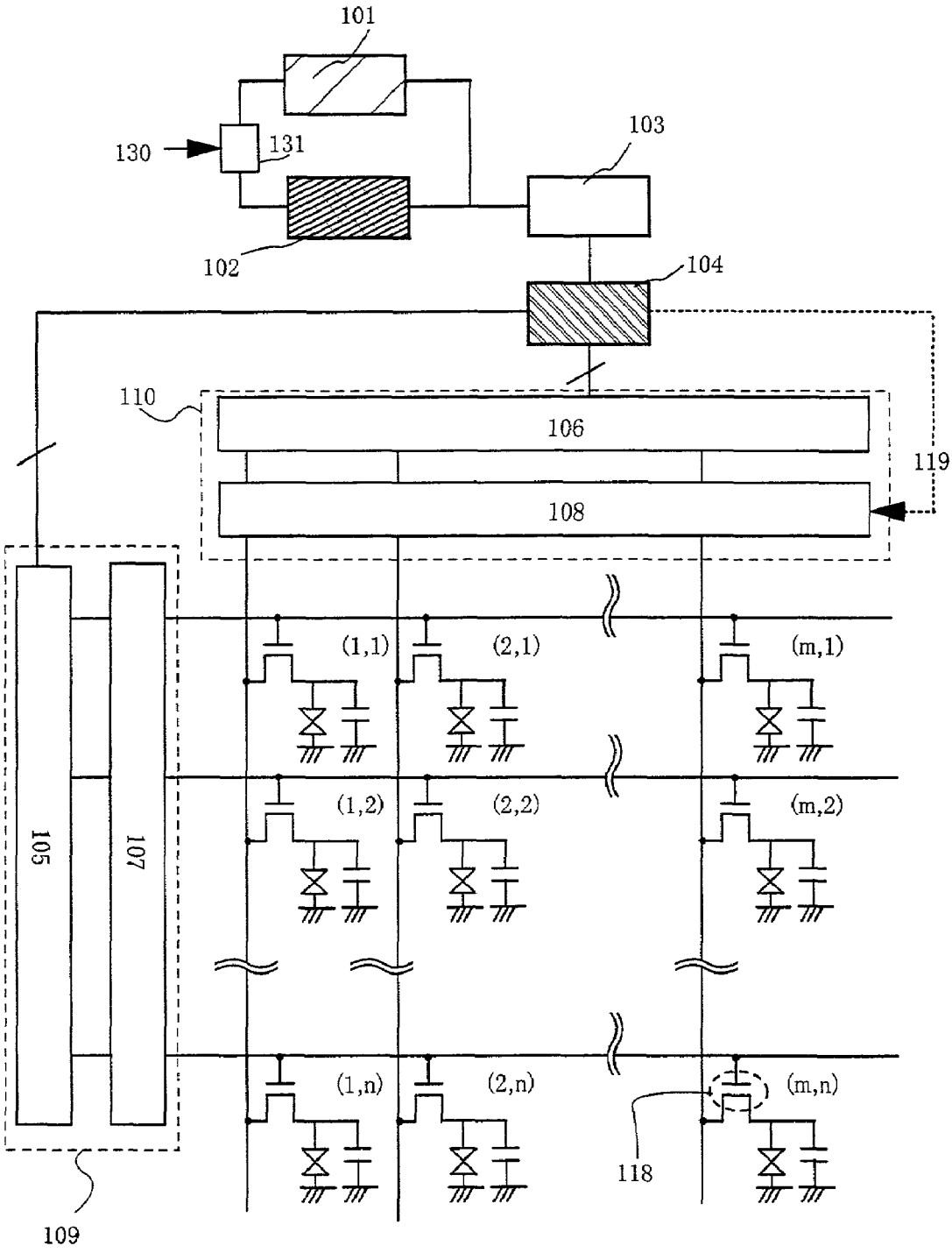
FIG. 1 shows an exemplary circuit configuration of a method of driving a liquid crystal display device according to the present invention.

A circuit configuration of the present invention will be described with reference to FIG. 1. FIG. 1 shows pixels and a driving circuit of the present embodiment mode. In FIG. 1, pixels are arranged in a matrix (m columns×n rows) in a pixel portion. An address of a pixel disposed in an i-th column and in a j-th row is represented as (i, j) (i is an integer of 1 to m, and j is an integer of 1 to n).

One frame period includes a first sub-frame period to a third sub-frame period. A video signal 130 in the first to third sub-frame periods, and an address of a pixel for receiving the video signal 130 are input to a first means or a second means in accordance with designation of a switching circuit 131.

The video signal 130 may be an analog signal or a digital signal. In the case where the video signal 130 is an analog signal, in order to memorize the video signal 130 with good precision, the video signal 130 may be converted into a digital signal by using an analog/digital converter (A/D converter) before being input to the first means or the second means.

A first means is provided for storing a potential of a first signal voltage applied to a pixel electrode in the first sub-frame period. The first means is referred to as first storage means 101 based on its function. Furthermore, a second means is provided for storing a potential of a second signal voltage applied to a pixel electrode in the second sub-frame period. The second means is referred to as second storage means 102 based on its function.

A third means is provided for operation of a response time of liquid crystal when a first signal voltage is changed to a second signal voltage in the same pixel TFT. The third means is referred to as comparison operation means 103 based on its function. For operation of a response time of liquid crystal, a theoretical value of a response time may be calculated from physical constants such as a rotation viscosity coefficient, an elastic constant and dielectric anisotropy of liquid crystal. It may also be possible that the relationship between the response time of liquid crystal and the driving voltage thereof is previously input to the comparison operation means 103, and the data is referred to. In accordance with a calculated response time of liquid crystal, the order of writing a signal of a signal line to a pixel TFT in the second sub-frame period is determined.

First, a response time of liquid crystal when the first signal voltage is changed to the second signal voltage is calculated with respect to all the pixels. It is assumed that a response time of liquid crystal is longest in a pixel at an address (2,2), and a response time becomes shorter in the order of pixels at addresses (2, 1), (1, 1), and (1, 2). More specifically, it is assumed that, among four pixels, a response time of liquid crystal when a pixel at an address (1, 2) is changed from the first signal voltage to the second signal voltage is shortest. In this case, when an image in the second sub-frame period is displayed, a signal of a signal line is written to a pixel TFT in the order of addresses: (2, 2), (2, 1), (1, 1), and (1, 2). That is, a signal of a signal line is written in the second sub-frame period in the order from a pixel TFT of a pixel with a longest response time of liquid crystal. For convenience, four pixels are illustrated here. However, in the case of n×m pixels, a signal of a signal line is also written in the order from a pixel TFT of a pixel with a longest response time of liquid crystal when the first signal voltage is changed to the second signal voltage. When a response time of liquid crystal is the same in a plurality of pixels, in order to alleviate the burden on a driving circuit, a signal of a signal line is written to a pixel TFT in the order from a closest pixel.

In the first sub-frame period, the comparison operation data storage means 104 stores the order of writing a signal of a signal line to a pixel TFT in the second sub-frame period.

A fourth means is provided for supplying a second signal voltage of a pixel electrode of a pixel, in the order from a pixel with a longest response time of liquid crystal. In the present embodiment mode, the fourth means includes an X address writing control means 110 having an X address decoder 106 and video signal output means 108 connected to the X address decoder 106, and a Y address writing control means 109 having a Y address decoder 105 and a level shifter 107 connected to the Y address decoder 105.

Among the fourth means, the X address writing control means 110 having the X address decoder 106 and the video signal output means 108 has a function of selecting a signal line connected to a pixel TFT, based on X address data output from the comparison operation data storage means 104. Furthermore, the Y address writing control means 109 having the Y address decoder 105 and the level shifter 107 has a function of selecting a scanning line connected to a pixel TFT, based on Y address data output from the comparison operation data storage means 104.

Based on the Y address data output from the comparison operation data storage means 104, the Y address decoder 105 addresses a scanning line of a pixel TFT in which a signal of a signal line is to be written. In the case of the SXGA (1280 (horizontal direction)×1024 (vertical direction)), if the number of input terminals of the Y address decoder 105 is set to be 10 in accordance with the number of pixels, $2^{10}$ scanning lines can be arbitrarily selected. Among the output terminals of the Y address decoder, an output pulse is output from an output terminal having a Y address designated by Y address data. A voltage of the output pulse is amplified by the level shifter 107, and a gate pulse is output to a scanning line having the designated Y address.

The X address decoder 106 addresses a signal line to which a potential of a signal voltage is applied. In the case of the SXGA (1280 (horizontal direction)×1024 (vertical direction)), the number of input terminals of the X address decoder 106 may be set to be 11 in accordance with the number of pixels. An output pulse is output from an output terminal at the X address designated by the X address decoder 106, and is input to the video signal output means 108. A video signal (signal voltage) is input to the signal line of the designated X address, whereby the signal voltage is applied to the signal line. Regarding a video signal 119, the order in which a video signal is written to a pixel TFT is determined by an external circuit (comparison operation data storage means 104), whereby the video signal 119 is input to the video signal output means 108.

In the case where a video signal input to the video signal output means is a digital signal, a digital/analog converter (D/A converter) is built in the video signal output means, thereby converting the digital signal into an analog signal.

Thus, a signal of a signal line is written successively to the pixel TFT 118 in accordance with the order stored in the comparison operation data storage means 104, whereby an image in the second sub-frame period is formed.

Figure 2:
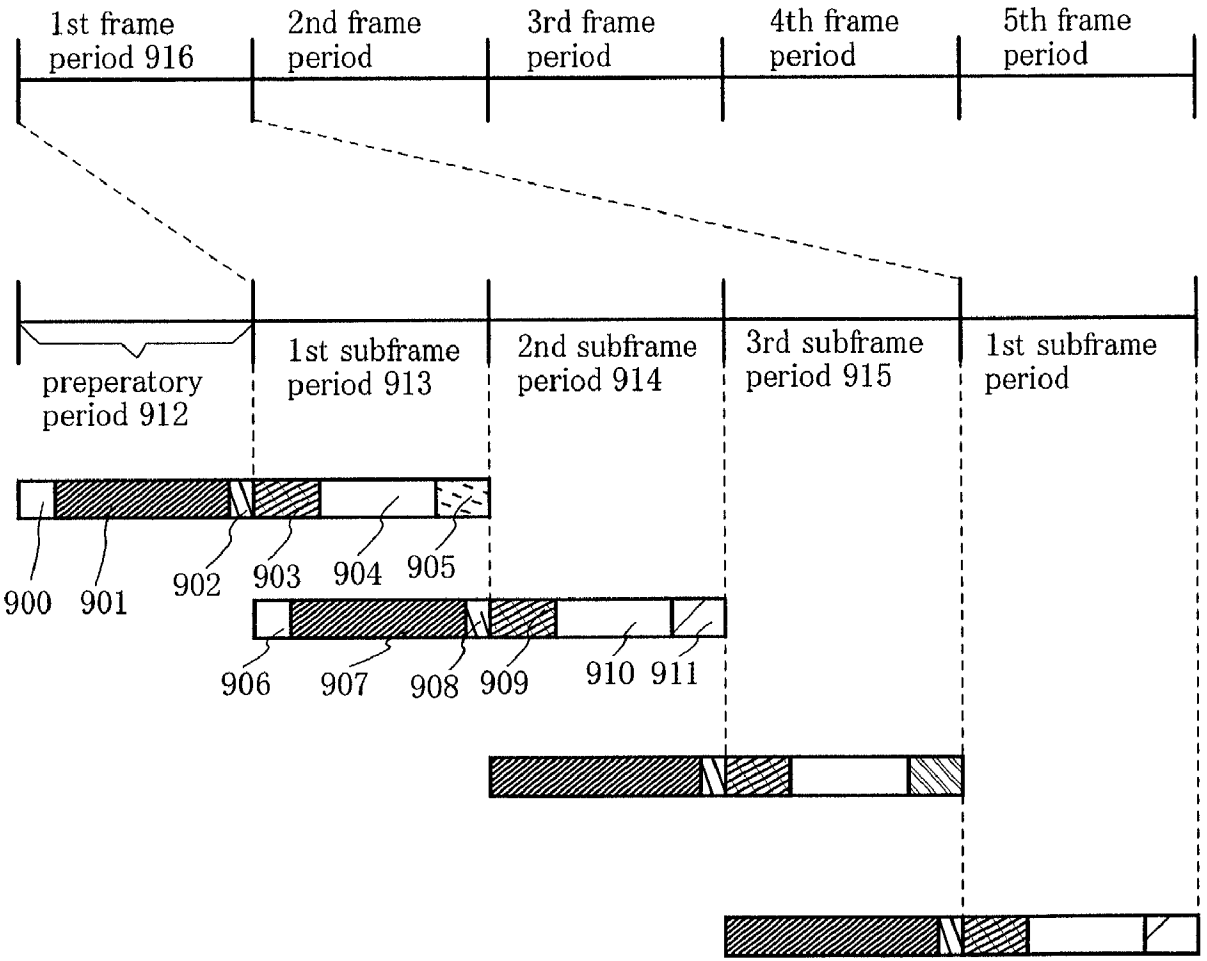
FIG. 2 shows an exemplary timing chart of a method of driving a liquid crystal display device according to the present invention.

An operation of the circuit will be described with reference to FIG. 2. By combining images displayed in the first to third sub-frame periods, a color image is displayed in the first frame period 916. A preparatory period 912 has first to third periods 900, 901, and 902. In the first period 900, the first storage means stores an address of a pixel TFT in the first sub-frame period and a first signal voltage written in the pixel TFT. In the second period 901, the comparison operation means calculates a response time of liquid crystal in each pixel when an image in the first sub-frame period is formed. In the third period 902, data in the comparison operation means is transferred to the comparison operation data storage means.

A first sub-frame period 913 has a writing period 903 for writing a signal of a signal line to a pixel TFT. The first sub-frame period 913 also has a liquid crystal response period 904 for liquid crystal to respond in accordance with the first signal voltage. The first sub-frame period 913 also has a lighting period 905 in which light sources are lighted. A first light emission color output from a light source during the first sub-frame period can be set to be red, for example, among three additive primary colors.

In the first sub-frame period 913, in order to form an image in the second sub-frame period, the order of writing a second signal voltage to a pixel TFT is simultaneously determined. The first storage means has already stored a first signal voltage in pixels at X and Y addresses in the first sub-frame period. Therefore, in a fourth period 906, the second storage means stores a second signal voltage in pixels at X and Y addresses in the second sub-frame period. Then, in a fifth period 907, the comparison operation means calculates a response time of liquid crystal when the first signal voltage is changed to the second signal voltage, and determines the order of selecting pixels from the operation results. In a sixth period 908, the data in the comparison operation means is transferred to the comparison operation data storage means.

In a second sub-frame period 914, the pixel data in the comparison operation data storage means is written in a pixel. The second sub-frame period 914 has a writing period 909 of pixel data, a liquid crystal response period 910, and a lighting period 911 of light sources. A second light emission color output from a light source can be set to be green, for example.

An image in a third sub-frame period is formed by a circuit operation in accordance with the second sub-frame period. In a third sub-frame period 915, a third light emission color output from a light source can be set to be blue, for example. Thus, in the first frame period, a color image is formed. By repeating the above-mentioned processes, animation composed of color images can be displayed.

Figure 7:
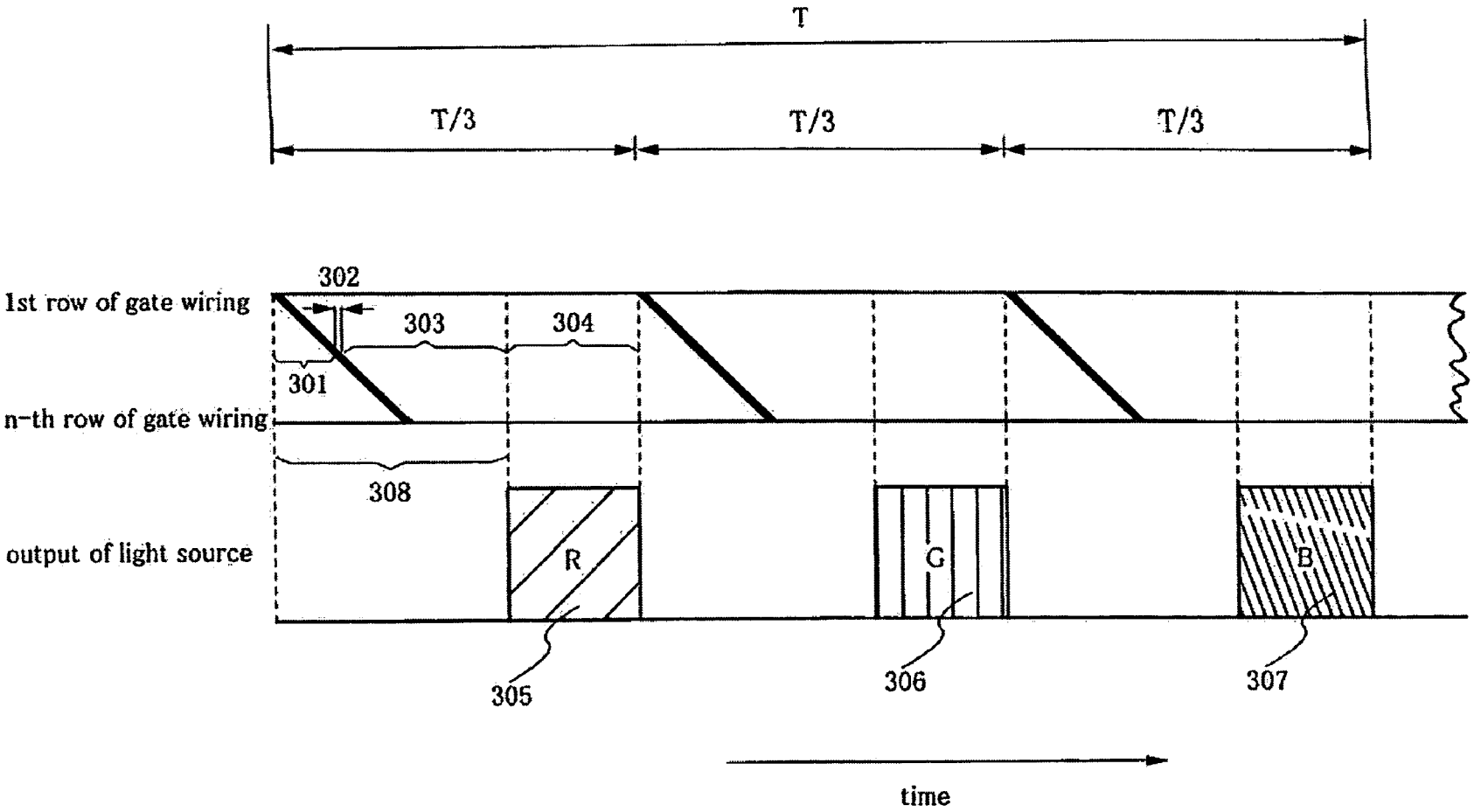
Fig. 7 (Prior Art)
FIG. 7 shows an exemplary timing chart in the case of conducting a color display by the field sequential system.

Referring to a timing chart of the field sequential system in FIG. 7, according to the present invention, a standby period 301 of a pixel having a long response period 303 of liquid crystal can be shortened. Therefore, compared with the conventional example, the sum of the standby period 301 and the liquid crystal response period 303 can be shortened. Because of this, the lighting period 304 of a light source can be prolonged. Furthermore, a method of conducting a color display in accordance with the field sequential system in which light sources are intermittently lighted is combined with the present embodiment mode, and light sources are not lighted in a liquid crystal response period. Therefore, even if pixels are selected at random, random write is not recognized by a user.

Figure 3:
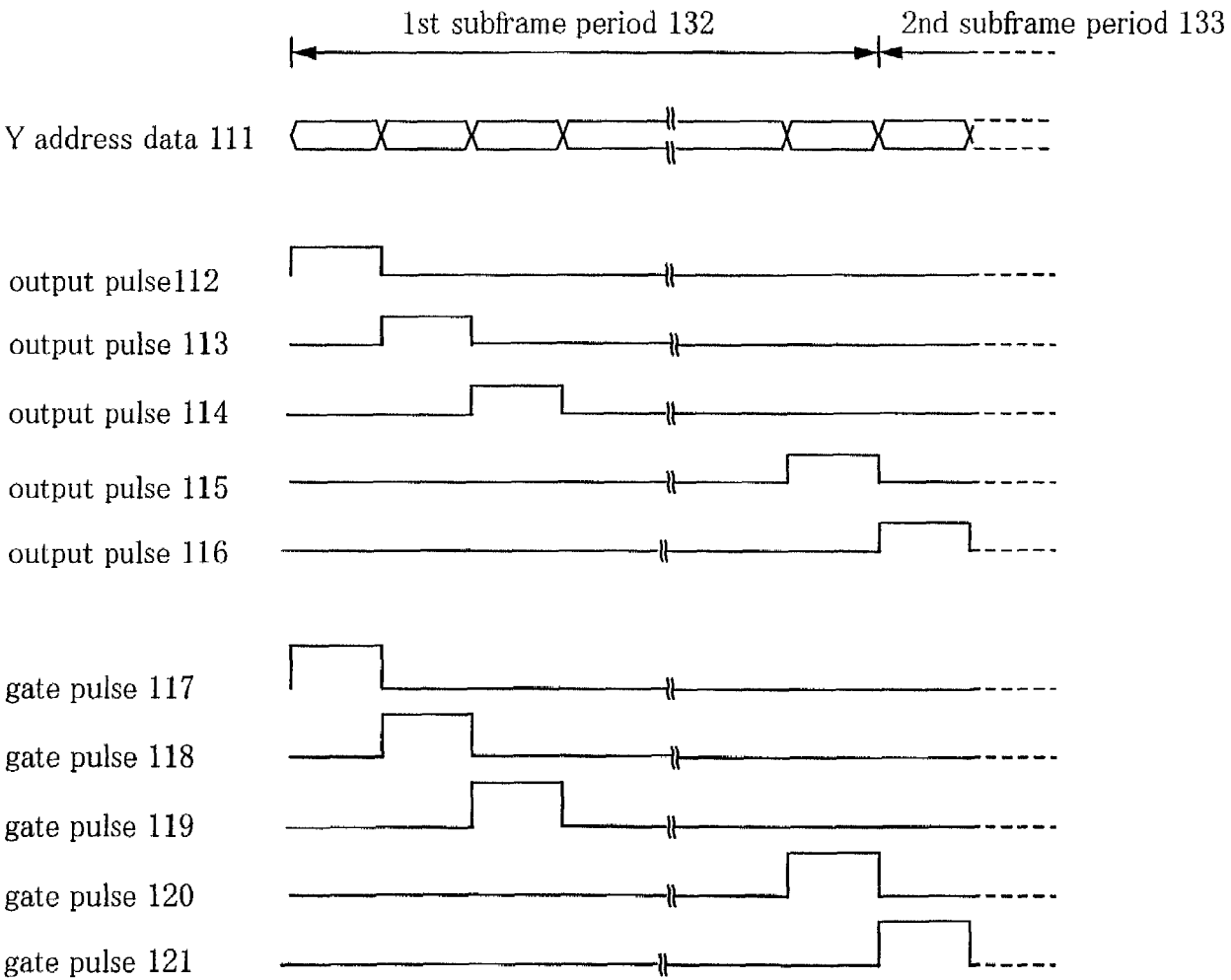
FIG. 3 shows an exemplary timing chart of a method of driving a liquid crystal display device according to the present invention.

FIG. 3 shows a timing chart of the Y address writing control means 109. A driving circuit having a level shifter and a Y address decoder is referred to as Y address writing control means. The Y address writing control means selects a scanning line connected to a pixel TFT.

The following description will be made with reference to the timing chart of the Y address writing control means. First, a plurality of Y address data 111 are input to input terminals of the Y address decoder. For example, when the number of scanning lines is 1024, the number of X address data is 10 so as to select either one of 1024 scanning lines, and each X address data has "0" or "1" information. An output pulse 112 is output from an output terminal of the Y address decoder having the Y address designated by the Y address data. The output pulse 112 has a voltage value amplified by the level shifter, and converted into a gate pulse 117. The gate pulse 117 is output to a scanning line of the designated Y address. Thus, a scanning line connected to a pixel TFT of a pixel, in which a response time of liquid crystal is long, is preferentially selected. In a first sub-frame period 132, in accordance with the order of pixel TFTs in which a first signal voltage is written, output pulses 112 to 116 are successively output to the designated Y address. The output pulses 112 to 116 are converted into gate pulses 117 to 121, and a scanning line is selected. In a second sub-frame period 133, in the same way as in the first sub-frame period 132, output pulses are converted into gate pulses, and a scanning line connected to a pixel TFT of pixel in which a response time of liquid crystal is long is selected first. Thereafter, formation of an image is repeated at a timing in accordance with the above.

For example, it is assumed that, in a VGA (640 pixels (horizontal direction)×480 pixels (vertical direction)) display device, pixels with a long response time of liquid crystal are in the following order: (1, 5), (6, 2), (150, 4), . . . (60, 3), (200, 300). That is, it is assumed that a response time of liquid crystal is longest in the pixel (1, 5), and a response time of liquid crystal is shortest in a pixel (200, 300). In this case, a gate pulse 117 is output to a scanning line having an address of G5, and a gate pulse 118 is output to a scanning line having an address of G2, and a gate pulse 119 is output to a scanning line having an address of G4. Then, a gate pulse 120 is output to a scanning line having an address of G3, and a gate pulse 121 is output to a scanning line having an address of G300.

Figure 4:
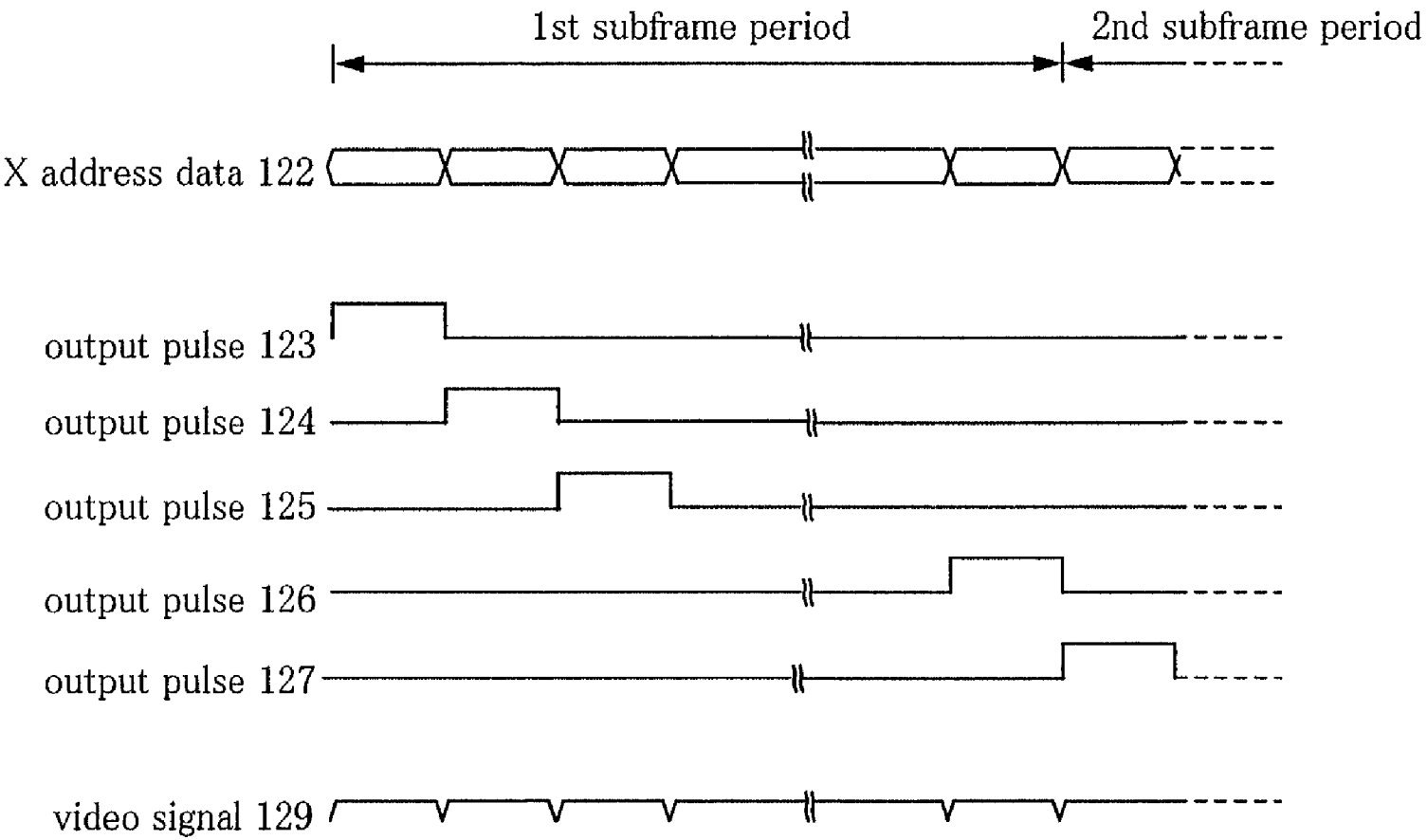
FIG. 4 shows an exemplary timing chart of a method of driving a liquid crystal display device according to the present invention.

FIG. 4 shows a timing chart of the X address writing control means 110. A driving circuit composed of an X address decoder and a video signal output circuit is referred to as X address writing control means. The X address writing control means selects a signal line connected to a pixel TFT.

The following description will be made with reference to the timing chart of the X address writing control means. First, X address data 122 showing the order of selecting signal lines is input to an input terminal of the X address decoder. For example, in the case where the number of signal lines is 1240, the number of Y address data is 11 so as to select either one of 1240 signal lines. Each Y address data has "0" or "1" information. Output pulses 123 to 127 are output from output terminals at the X address designated by the X address data 122, among the output terminals of the X address decoder. A video signal 129 is input to a signal line at the designated X address, and supplies a potential of a signal voltage to the signal line. In the second sub-frame period, in the same way as in the first sub-frame period, a signal line connected to a pixel TFT of a pixel with a longest response time of liquid crystal is preferentially selected. Thereafter, formation of an image is repeated at a timing in accordance with the above.

For example, it is assumed that, in a VGA (640 pixels (horizontal direction)×480 pixels (vertical direction)) display device, pixels with a long response time of liquid crystal are in the following order: (1, 5), (6, 2), (150, 4), . . . (60, 3), (200, 300). That is, it is assumed that a response time of liquid crystal is longest in the pixel (1, 5), and a response time of liquid crystal is shortest in a pixel (200, 300). In this case, after an output pulse 123 is output to a signal line having an address of S1, an output pulse 124 is output to a signal line having an address of S6, and an output pulse 125 is output to a signal line having an address of S150. Then, an output pulse 126 is output to a signal line having an address of S60, and an output pulse 127 is output to a signal line having an address of S200.

A pulse width of the output pulse output from the X address decoder is the same as that output from the Y address decoder. The number of output pulses output from the X address decoder and the Y address decoder in a pixel portion having pixels arranged in a matrix (m columns×n rows) is m×n, respectively, and data is written on the pixel basis in the order from a pixel with a longest response time.

Embodiment Mode 2

Figure 5:
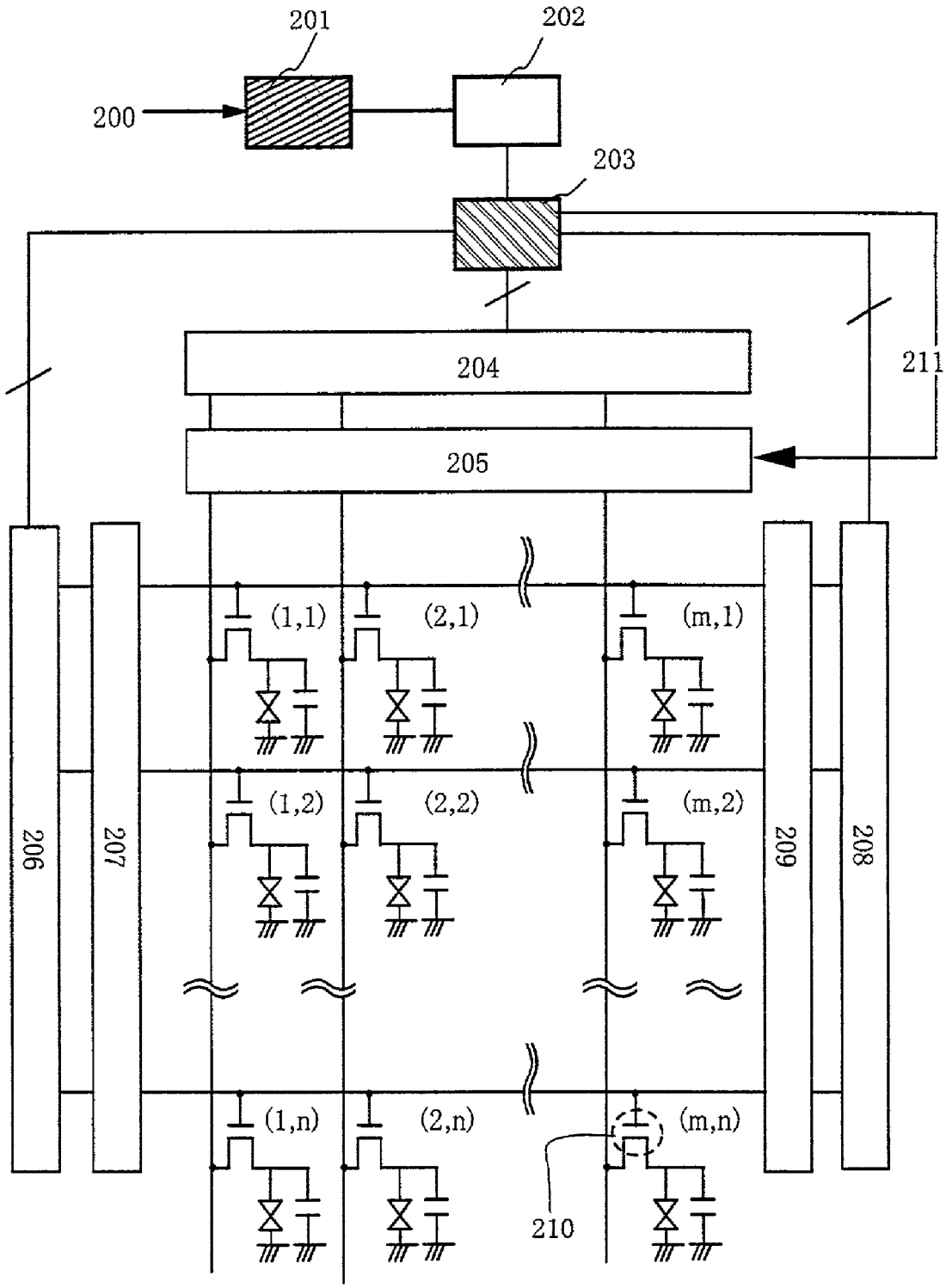
FIG. 5 shows an exemplary circuit configuration of a method of driving a liquid crystal display device according to the present invention.

FIG. 5 shows Embodiment Mode 2 of the present invention. In FIG. 5, a plurality of address decoders, i.e., a first Y address decoder and a second Y address decoder are provided. In FIG. 5, the address of a pixel arranged in an i-th column and a j-th row is represented as (i, j) (i is an integer of 1 to m, and j is an integer of 1 to n).

First, a storage means 201 stores data of a video signal (signal voltage) 200 at an X address and a Y address in the first sub-frame period. The Y address represents an address of a signal line, and the X address represents an address of a scanning line.

More specifically, the storage means 201 stores the video signal and an address of a pixel to which the video signal is input.

A first means for detecting pixel TFTs connected to the same signal line and displaying the same gray-scale is programmed so as to simultaneously write a signal of a signal line to pixel TFTs of pixels conducting a display with the same signal voltage in a plurality of pixel TFTs 210 connected to a signal line at the same X address. In the present embodiment mode, the first means is referred to as comparison means 202 based on its function. It is assumed that, among pixel TFTs connected to a signal line at the X address of 1, pixels at the Y address of 1, 10, and n conduct a display with the same signal voltage, and the comparison means 202 detects pixel TFTs at addresses (1, 1), (1, 10), and (1, n) in the first frame period. In the present embodiment mode, for convenience of description, it is assumed that two pixel TFTs at maximum are simultaneously supplied with the same signal voltage. Furthermore, it is assumed that a pixel TFT for writing a signal of a signal line simultaneously with the pixel TFT at the address (1, 1) is the one of the remaining two pixels (1, 10) and (1, n) at a Y address with a larger value, i.e., the pixel TFT at the address (1, n). The reason for this is as follows. According to dot-sequential driving, in a pixel TFT at a Y address with a larger value, there is a tendency that it takes a longer time to write a signal of a signal line, and a standby period 301 in FIG. 7 becomes longer in the field sequential system. Therefore, it is better to preferentially select a pixel TFT at a Y address with a larger value. Needless to say, by altering the design of a driving circuit, it is also possible to simultaneously apply a signal of a signal line to three pixel TFTs, instead of that two pixel TFTs are simultaneously supplied with a signal of a signal line.

Next, the comparison data storage means 203 successively stores the order of writing a signal of a signal line to pixels, determined by the comparison means 202.

Second means is provided for simultaneously applying a potential of a signal voltage to pixel electrodes of a plurality of pixel TFTs. In the present embodiment mode, the second means includes an X address decoder 204, video signal output means 205, a first Y address decoder 206, a second Y address decoder 208, a first level shifter 207, and a second level shifter 209.

The X address decoder 204 selects an address of a signal line based on X address data output from the comparison data storage means 203. The first Y address decoder 206 and the second Y address decoder 208 select an address of a scanning line based on Y address data output from the comparison data storage means 203.

The X address decoder 204 outputs an output pulse from an output terminal at an X address designated based on the X address data output from the comparison data storage means 203. Although not shown, in the case of a liquid crystal display device with the number of pixels of SXGA, the number of input terminals of the X address decoder is 11, and the number of output terminals thereof is 1280. The X address decoder 204 designates an X address of a signal line to which a potential of a signal voltage is applied. Herein, it is assumed that 1 is designated as an X address.

The video signal output means 205 supplies a video signal to a signal line at the X address designated based on the X address data. A video signal 211 is input to the video signal output means 205 in accordance with the order determined by an external circuit (comparison data storage means 203).

The first Y address decoder 206 outputs an output pulse from an output terminal at a Y address designated based on the Y address data output from the comparison data storage means 203. Although not shown, in the case of a liquid crystal display device with the number of pixels of SXGA, the number of input terminals of the Y address decoder is 10, and the number of output terminals thereof is 1024. It is assumed that an output pulse is output from an output terminal of the first Y address decoder at a Y address of 1. It is also assumed that an output pulse is output from an output terminal of the second Y address decoder 208 at a Y address of n.

The first level shifter 207 connected to the first Y address decoder 206 and the second level shifter 209 connected to the second Y address decoder amplify a voltage of an output pulse to generate a gate pulse having a gate voltage.

A scanning line and a signal line at an address designated by the first Y address decoder, the second Y address decoder, and the X address decoder are selected, whereby pixel TFTs having addresses (1, 1) and (1, n) among the pixel TFTs 210 are selected, and a signal of a signal line is written therein. Thus, an address of a pixel TFT is successively designated, whereby a signal of a signal line is written in a pixel TFT. In the present embodiment mode, since a signal of a signal line can be simultaneously written in two pixel TFTs at maximum, a total time for giving a signal of a signal line to a pixel TFT, i.e., a scanning period of scanning lines can be shortened.

An operation of the circuit will be described with reference to FIG. 2. A preparatory period 912 has first to third periods 900, 901, and 902. In the first period 900, data of a signal voltage at an X address and a Y address in the first frame period is input to the storage means. In the second period 901, the comparison means detects pixel TFTs in which the same signal voltage is written among the pixel TFTs connected to the same signal line, and confirms Y addresses of the detected pixel TFTs. In the third period 902, the order of giving a signal of a signal line to the pixel TFTs determined by the comparison means is written in the comparison data storage means.

A first sub-frame period 913 has a writing period 903 for writing a signal of a signal line to a pixel TFT for the purpose of displaying an image in the pixel TFT. The first sub-frame period 913 also has a liquid crystal response period 904 for liquid crystal to respond in accordance with the first signal voltage. The first sub-frame period 913 also has a lighting period 905 in which light sources are lighted. A first light emission color output from a light source during the first sub-frame period can be set to be red, for example, among three additive primary colors.

The first sub-frame period 913 has a fourth period 906 in which data of a signal voltage at an X address and a Y address in a second sub-frame period 914 is simultaneously input. The first sub-frame period 913 also has a fifth period 907 in which the comparison means detects addresses of pixel TFTs in which a signal of a signal line is simultaneously written in the second sub-frame period. The first sub-frame period 913 also has a sixth period 908 in which the order of writing a signal of a signal line determined by the comparison means is written in the comparison data storage means.

Thereinafter, in the second sub-frame period 914, an operation of applying a signal of a signal line to a pixel TFT is started, and a light source is lighted to form a monochromic image. A second light emission color emitted from a light source can be set to be green. In the second sub-frame period 914, in order to form an image in a third sub-frame period 915, the order of writing a signal voltage to a pixel TFT is simultaneously determined. There is an operation of the circuit in accordance with the fourth to sixth periods. In a lighting period of a light source during the third sub-frame period 915, a monochromic image is displayed. A third light emission color emitted by a light source can be set to be blue. Thus, a color image is formed in the first frame period 916. Thereafter, the same operation is repeated successively to display animation.

As described above, an image for displaying animation can be formed by a driving method in which a signal of a signal line is simultaneously written in a plurality of pixel TFTs connected to the same signal line and displaying the same gray-scale to shorten a scanning period of scanning lines.

In FIG. 5, the first Y address decoder and the second Y address decoder are provided in the driving circuits connected to both ends of the scanning lines. Therefore, the maximum number of pixels allowed to have a potential of the same signal voltage at the same time is two. However, the present embodiment mode is not limited thereto. By modifying a circuit configuration, at least three pixel TFTs for receiving a potential of the same signal voltage can be selected from the pixel TFTs connected to the same signal line. In this case, instead of providing the first Y address decoder 206 and the second Y address decoder 208 in FIG. 5, a circuit (referred to as a scanning line selection circuit) capable of selecting a plurality of scanning lines may be provided between the comparison data storage means 203 and the first level shifter 207, and at least three scanning lines may be simultaneously selected by the scanning line selection circuit. In this case, the second level shifter 209 is not required.

According to the present embodiment mode, in dot-sequential driving, a scanning period of scanning lines required for giving a potential of a predetermined signal voltage to pixels can be shortened. This will be described, for example, with reference to the timing chart in FIG. 7. The sum of the standby period 301 and the liquid crystal response period 303 can be shortened. Furthermore, the comparison operation means 102 for calculating a response time in FIG. 1 is not required, so processing in the circuit becomes easier, and the circuit configuration becomes simple, compared with Embodiment Mode 1.

A timing chart of the circuit of the present embodiment mode will be described with reference to a timing chart in FIG. 4. In the present specification, an X address decoder and video signal output means are collectively referred to as X address writing control means. The X address writing control means selects a scanning line connected to pixel TFTs. X address data 122 have "0" or "1" information, respectively. In the case where the number of scanning lines is 1024, 10 X address data are simultaneously input to the X address decoder. An output pulse 123 is output from the output terminal at a designated X address among the output terminals of the X address decoder, based on the X address data 122. Unlike Embodiment Mode 1, an output pulse may be successively output from a first column to an m-th column of signal lines in the present embodiment mode. At the same time that the output pulse 123 is output, a video signal pulse 129 is output to a signal line at a designated X address. Because of the above operation, a signal is given to a signal line at the X address designated based on the X address data.

Figure 6:
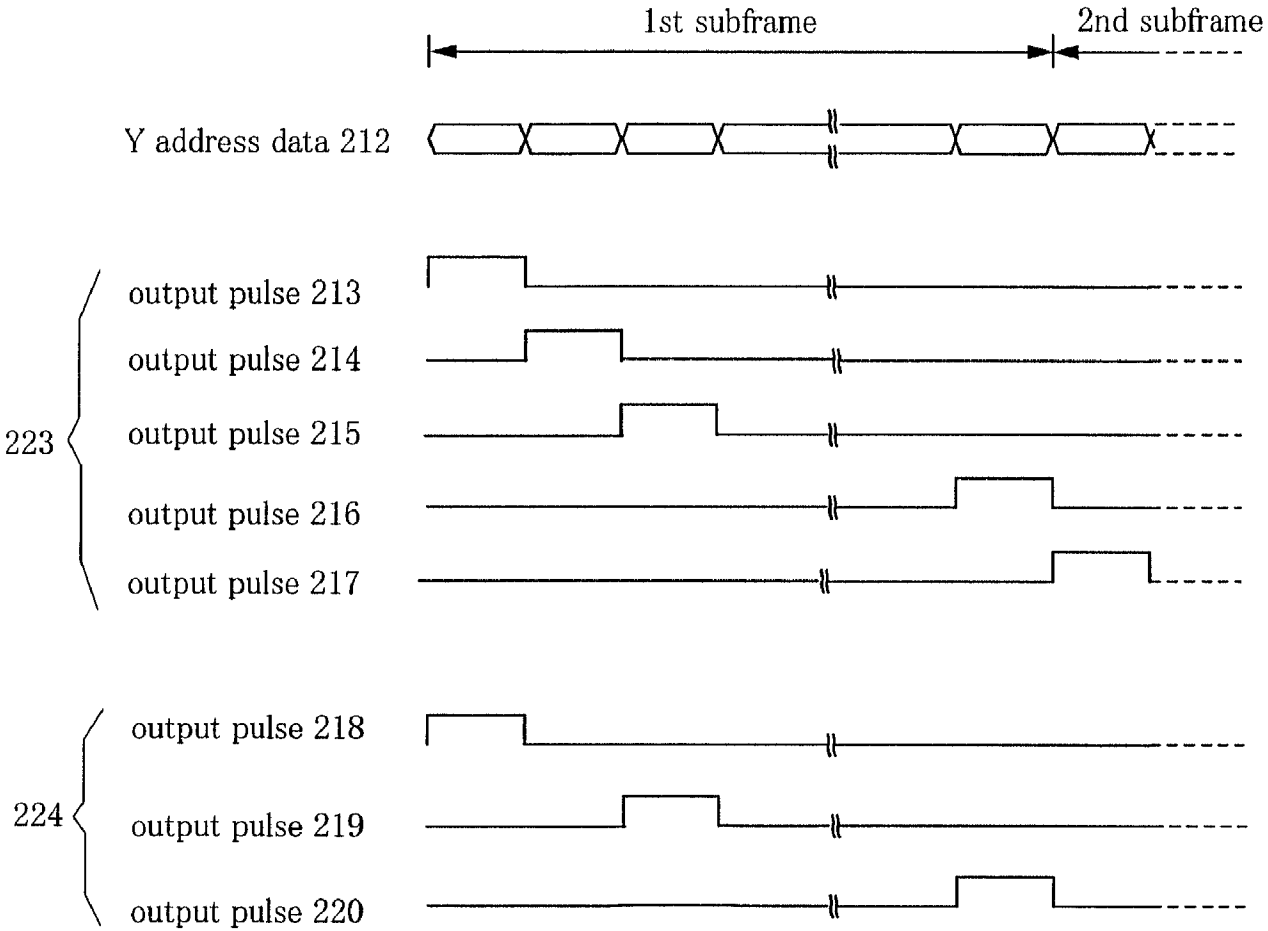
FIG. 6 shows an exemplary timing chart of a method of driving a liquid crystal display device according to the present invention.

In the present specification, the first Y address decoder and the first level shifter are collectively referred to as first Y address writing control means. In the present specification, the second Y address decoder and the second level shifter are collectively referred to as second Y address writing control means. The first Y address writing control means and the second Y address writing control means select a signal line connected to pixel TFTs. A voltage of an output pulse output from the first Y address decoder and the second Y address decoder are amplified by the first level shifter or the second level shifter, in the same way as in Embodiment Mode 1. Therefore, operations of the first Y address decoder and the second Y address decoder will be described with reference to FIG. 6.

Y address data have "0" or "1" information, respectively. An address of a terminal of the Y address decoder to which an output pulse is output is determined based on the Y address data. For example, when the number of signal lines is 1240, in order to select either one of 1240 signal lines, there are 11 Y address data, and each Y address data has "0" or "1" information.

In a first sub-frame period, an output pulse 213 is output from an output terminal of the first Y address decoder at a Y address designated based on Y address data 212. In the present embodiment mode, a first scanning line in a first column is first selected, so an output pulse is output from an output terminal at a Y address of 1. The total number of output pulses 213 to 216 output from the first Y address decoder 223 is (m×n) or less from a circuit operation, when there are n rows of scanning lines and m columns of signal lines.

If there is a second pixel TFT for writing a signal of the same signal line as that of a first pixel TFT connected to the first scanning line, in order to select a Y address of a second scanning line connected to the second pixel TFT, an output pulse 218 is output from an output terminal of the second Y address decoder, corresponding to an address of the second scanning line. Output pulses 218 to 220 output from the second Y address decoder 224 are output only when there are pixel TFTs that are connected to different scanning lines and in which a signal of a signal line is simultaneously written.

Thereinafter, similarly, when there are two pixel TFTs in which a signal of a signal line is simultaneously written, output pulses are output from the first and second Y address decoders to select a scanning line.

The pulse widths of the output pulses output from the X address decoder, the first Y address decoder, and the second Y address decoder are the same.

According to the method of the present embodiment mode, a time required for writing a signal in all the pixels can be shortened.

Embodiment Mode 3

Embodiment Mode 3 of the present invention will be described with reference to FIG. 5. The present embodiment mode is characterized in that a first signal voltage is simultaneously written in a plurality of pixel TFTs connected to the same signal line, i.e., a first pixel TFT and a second pixel TFT. Embodiment Mode 3 is different from Embodiment Mode 2 in that a second pixel TFT is supplied with a first signal voltage so as to allow liquid crystal to respond, and then, a second signal voltage is written in the second pixel TFT. By allowing liquid crystal to respond twice, a time for liquid crystal to respond after the second signal voltage is written in the second pixel TFT can be shortened. It is assumed that the difference between the absolute value of the first signal voltage and that of the second signal voltage is between 0 volt and 0.5 volt. Hereinafter, an approximated gray-scale refers to a gray-scale that can be displayed when the difference between the first and second signal voltages applied to liquid crystal is between 0 volt and 0.5 volt.

First, storage means 201 stores a video signal (signal voltage) 200 at an X address and a Y address in a first sub-frame period.

Then, when an image on one screen is displayed, comparison means 202 detects a first pixel TFT and a second pixel TFT among a plurality of pixel TFTs connected to the same signal line. The first pixel TFT has a first pixel electrode supplied with a potential of a first signal voltage. The second pixel TFT has a second pixel electrode supplied with a potential of a second signal voltage with an absolute value whose difference from that of the first signal voltage is between 0 volt and 0.5 volt. Then, the first pixel electrode and the second pixel electrode are supplied with a potential of the first signal voltage. Thereafter, the second pixel electrode is supplied with a second signal voltage. There may be one or a plurality of second pixel TFTs, depending upon an image desired to be displayed.

Unlike Embodiment Mode 2, the driving method of the present embodiment mode has a first stage. In the first stage, even if there is no pixel, in which the same signal voltage as that of a first pixel TFT is written, among pixel TFTs connected to a signal line, when a first pixel having the first pixel TFT connected to a signal line and a first scanning line and a second pixel having a second pixel TFT connected to the signal line and a second scanning line display an approximate gray-scale level, a first signal voltage is written in the first pixel TFT and the second pixel TFT. In the present embodiment mode, it is assumed that, in the first stage, a signal of the same signal line is simultaneously written in two pixels at maximum. In addition, in dot-sequential driving, a pixel connected to a scanning line at an X address with a larger value is supplied with a potential of a predetermined voltage later, and the standby period 301 in FIG. 7 tends to become long. Therefore, it is assumed that a pixel connected to a scanning line at an X address with a larger value is preferentially selected.

Next, in a second stage of the driving method of the present embodiment mode, scanning lines are successively selected from a first scanning line to a second scanning line to write a signal of a signal line to pixels. Needless to say, if two pixel TFTs connected to the same signal line show an approximate gray-scale while scanning lines are selected from the first scanning line to the second scanning line, a signal of a signal line may be simultaneously written in these two pixel TFTs.

Thereafter, in a third stage of the driving method of the present embodiment mode, a second signal voltage at a normal gray-scale level is written in the second pixel TFT in which the first signal voltage has already been written. The difference between the absolute value of the second signal voltage and that of the first signal voltage is between 0 volt and 0.5 volt.

Thus, the comparison means 202 determines the order of writing a signal of a signal line to pixels. More specifically, the comparison means 202 is programmed so as to conduct operations in the first to third stages.

The driving method of the present embodiment mode is characterized in that a signal of a signal line is previously written in a second pixel displaying a gray-scale level approximate to that of a first pixel simultaneously with the first pixel TFT, thereby allowing liquid crystal to respond. Because of this, by the time when a second signal voltage is written in a second pixel TFT, liquid crystal has responded up to an approximate gray-scale level. Therefore, a response time for liquid crystal to respond to a predetermined gray-scale (determined by the second signal voltage) after the second signal voltage is written is shortened.

Next, a comparison data storage means 203 stores the order of pixel TFTs in which a signal of a signal line is written, determined by the comparison means 202.

The X address decoder 204 designates an address of a signal line, and a video signal output means 205 supplies a video signal 211 to an X address of the designated signal line. The video signal is input to the video signal output means in accordance with the order of pixels to be selected.

A first Y address decoder 206 outputs an output pulse from an output terminal designated based on the output Y address data. A first level shifter 207 amplifies a voltage value of an output pulse output from the first Y address decoder to set the first scanning line at a gate potential.

A second Y address decoder 208 and a second level shifter 209 set a second scanning line at a gate potential.

Thus, the first pixel TFT connected to the signal line and the first scanning line and the second pixel TFT connected to the signal line and the second scanning line are simultaneously supplied with the same signal voltage.

The operation of the circuit of the present embodiment mode is substantially the same as that described with reference to FIG. 2 in Embodiment Mode 2. The difference therebetween is that, in the present embodiment mode, when an image in the first sub-frame period is formed by the comparison means in the second period 901, an address of a pixel connected to the same signal line and displaying an approximate gray-scale is detected.

Needless to say, by modifying a circuit configuration, at least three pixel TFTs connected to the same signal line and displaying the same or approximate gray-scale level can be simultaneously selected.

In the present embodiment mode, by allowing liquid crystal of a pixel showing an approximate gray-scale level to previously respond, the sum of the response time 303 of liquid crystal and the standby time 301 in the timing chart of the field sequential system in FIG. 7 can be shortened.

Embodiment Mode 3 may be used in combination with Embodiment Modes 1 and 2. A signal of a signal line may be preferentially written in a pixel TFT of a pixel having a long response time. Alternatively, a signal of a signal line may be simultaneously written in a pixel TFT of a pixel showing the same or approximate gray-scale.

Embodiment 1

FIGS. 8 to 11 are used to explain embodiments of the present invention. In this embodiment, a manufacturing method is explained precisely according to steps which is forming pixel TFT of the pixel portion and the storage capacitor; driver circuit TFT provided in periphery portion of the display region simultaneously. In the TFT of the driver circuit manufactured in this embodiment has high movement semiconductor layer, so that the TFT is suitable for the high-speed writing pixel data in a field sequential system.

Figures 8A, 8B, 8C:
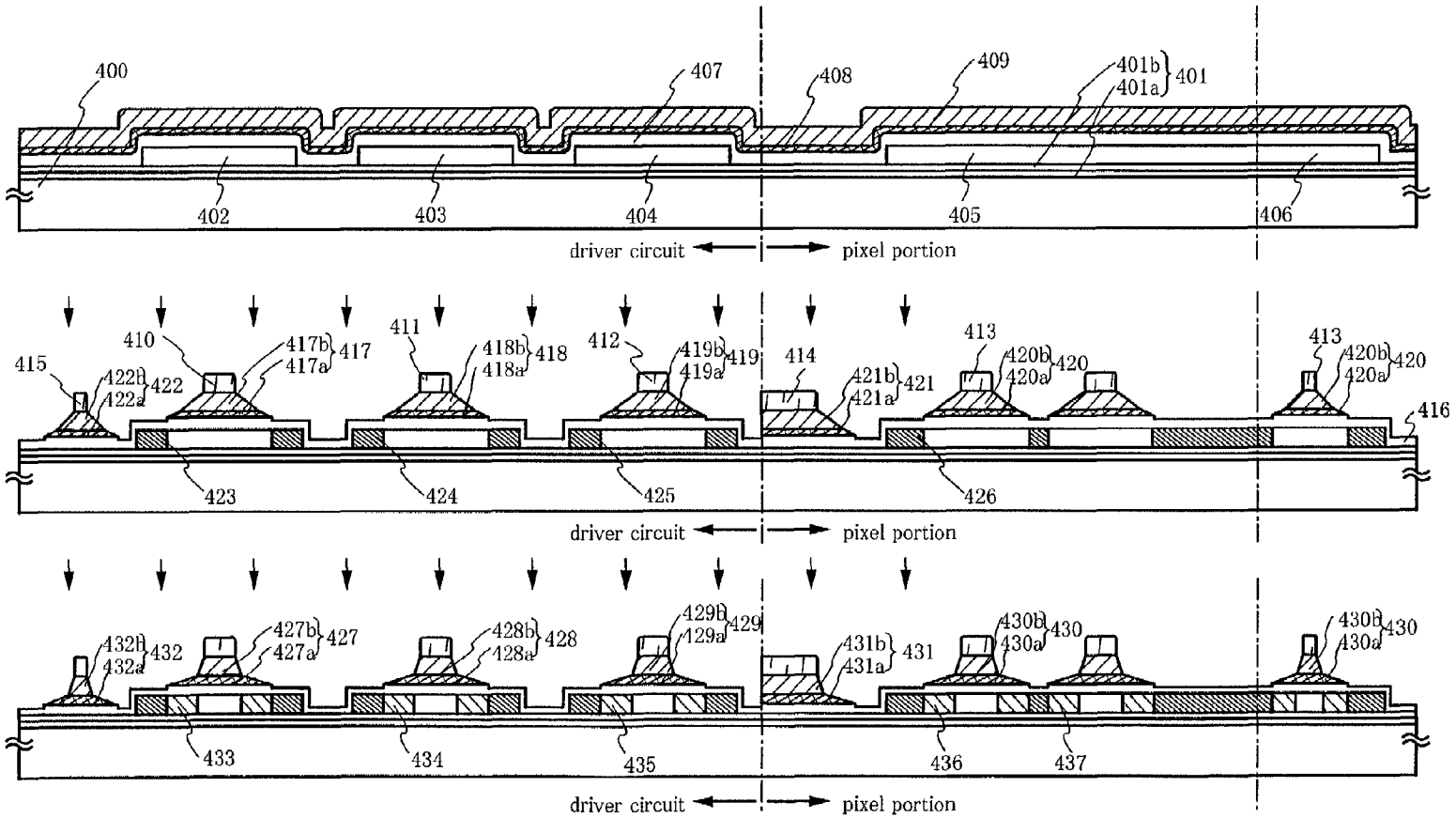
FIGS. 8A to 8C are cross-sectional views illustrating a method of manufacturing an active matrix substrate.

First, as shown in FIG. 8A, a base film 401 made of an insulating film such as a silicon oxide film, a silicon nitride film, or a silicon oxynitride film, is formed on a substrate 400 made of a glass such as barium borosilicate glass or aluminum borosilicate glass, typically a glass such as Corning Corp. #7059 glass or #1737 glass. For example, a lamination film of a silicon oxynitride film 401*a*, manufactured from $SiH_4$, $NH_3$, and $N_2O$ by plasma CVD, and formed having a thickness of 10 to 200 nm (preferably between 50 and 100 nm), and a hydrogenated silicon oxynitride film 401*b*, similarly manufactured from $SiH_4$ and $N_2O$, and formed having a thickness of 50 to 200 nm (preferably between 100 and 150 nm), is formed. A two-layer structure is shown for the base film 401 in Embodiment 1, but a single layer film of the insulating film, and a structure in which more than two layers are laminated, may also be formed.

Island shape semiconductor layers 402 to 406 are formed by crystalline semiconductor films made from a semiconductor film having an amorphous structure, using a laser crystallization method or a known thermal crystallization method. The thickness of the island shape semiconductor layers 402 to 406 may be formed from 25 to 80 nm (preferably between 30 and 60 nm). There are no limitations placed on the materials for forming a crystalline semiconductor film, but it is preferable to form the crystalline semiconductor films by silicon or a silicon germanium (SiGe) alloy.

A laser such as a pulse oscillation type or continuous light emission type excimer laser, a YAG laser, or a $YVO_4$ laser can be used to fabricate the crystalline semiconductor films by the laser crystallization method. A method of condensing laser light emitted from a laser oscillator into a linear shape by an optical system and then irradiating the light to the semiconductor film may be used when these types of lasers are used. The crystallization conditions may be suitably selected by the operator, but when using the excimer laser, the pulse oscillation frequency is set to 30 Hz, and the laser energy density is set form 100 to 400 mJ/cm$^2$ (typically between 200 and 300 mJ/cm$^2$). Further, when using the YAG laser, the second harmonic is used and the pulse oscillation frequency is set from 1 to 10 kHz, and the laser energy density may be set from 300 to 600 mJ/cm$^2$ (typically between 350 and 500 mJ/cm$^2$). The laser light condensed into a linear shape with a width of 100 to 1000 μm, for example 400 μm, is then irradiated over the entire surface of the substrate. This is performed with an overlap ratio of 80 to 98% for the linear laser light.

A gate insulating film 407 is formed covering the island shape semiconductor layers 402 to 406. The gate insulating film 407 is formed of an insulating film containing silicon with a thickness of 40 to 150 nm by plasma CVD or sputtering. A 120 nm thick silicon oxynitride film is formed in Embodiment 1. The gate insulating film is not limited to this type of silicon oxynitride film, of course, and other insulating films containing silicon may also be used in a single layer or in a lamination structure. For example, when using a silicon oxide film, it can be formed by plasma CVD with a mixture of TEOS (tetraethyl orthosilicate) and $O_2$, at a reaction pressure of 40 Pa, with the substrate temperature set from 300 to 400° C., and by discharging at a high frequency (13.56 MHz) electric power density of 0.5 to 0.8 W/cm$^2$. Good characteristics as a gate insulating film can be obtained by subsequently performing thermal annealing, at between 400 and 500° C., of the silicon oxide film thus manufactured.

A first conductive film 408 and a second conductive film 409 are then formed on the gate insulating film 407 in order to form gate electrodes. The first conductive film 408 is formed of a TaN film with a thickness of 50 to 100 nm, and the second conductive film 409 is formed of a W film having a thickness of 100 to 300 nm, in Embodiment 1.

The W film is formed by sputtering with a W target, which can also be formed by thermal CVD using tungsten hexafluoride ($WF_6$). Whichever is used, it is necessary to make the film become low resistance in order to use it as the gate electrode, and it is preferable that the resistivity of the W film be made equal to or less than 20 μΩcm. The resistivity can be lowered by enlarging the crystal grains of the W film, but for cases in which there are many impurity elements such as oxygen within the W film, crystallization is inhibited, thereby the film becomes high resistance. A W target having a purity of 99.9999% is thus used in sputtering. In addition, by forming the W film while taking sufficient care that no impurities from the gas phase are introduced at the time of film formation, the resistivity of 9 to 20 μΩcm can be achieved.

Note that, although the first conductive film 408 is a TaN film and the second conductive film 409 is a W film in Embodiment 1, both may also be formed from an element selected from the group consisting of Ta, W, Ti, Mo, Al, and Cu, or from an alloy material having one of these elements as its main constituent, and a chemical compound material. Further, a semiconductor film, typically a polycrystalline silicon film into which an impurity element such as phosphorus is doped, may also be used. Examples of preferable combinations other than that used in Embodiment 1 include: forming the first conductive film by tantalum (Ta) and combining it with the second conductive film formed from a W film; forming the first conductive film by tantalum nitride (TaN) and combining it with the second conductive film formed from an Al film; and forming the first conductive film by tantalum nitride (TaN) and combining it with the second conductive film formed from a Cu film.

Then, masks 410 to 415 are formed from resist, a resist and a first etching treatment is performed in order to form electrodes and wirings. An ICP (inductively coupled plasma) etching method is used in Embodiment 1. An etching gas is mixed, and a plasma is generated by applying a 500 W RF electric power (13.56 MHz) to a coil shape electrode at 1 Pa. A 100 W RF electric power (13.56 MHz) is also applied to the substrate side (test piece stage), effectively applying a negative self-bias voltage. Selecting appropriately etching gas, the W film and the TaN film are etched to the approximately same level.

Edge portions of the first conductive layer and the second conductive layer are made into a tapered shape in accordance with the effect of the bias voltage applied to the substrate side under the above etching conditions by using a suitable resist mask shape. The angle of the tapered portions is from 15 to 45°. The etching time may be increased by approximately 10 to 20% in order to perform etching without any residue remaining on the gate insulating film. The selectivity of a silicon oxynitride film with respect to a W film is from 2 to 4 (typically 3), and therefore approximately 20 to 50 nm of the exposed surface of the silicon oxynitride film is etched by this over-etching process. First shape conductive layers 417 to 422 (first conductive layers 417*a* to 422*a* and second conductive layers 417*b* to 422*b*) are thus formed of the first conductive layers and the second conductive layers in accordance with the first etching process. Reference numeral 416 denotes a gate insulating film, and the regions not covered by the first shape conductive layers 417 to 422 are made thinner by etching of about 20 to 50 nm.

A first doping process is then performed, and an impurity element which imparts n-type conductivity is added. (FIG. 8B) Ion doping or ion injection may be performed for the method of doping. Ion doping is performed under the conditions of a dose amount of from $1\times10^{13}$ to $5\times10^{14}$ atoms/cm$^2$ and an acceleration voltage of 60 to 100 keV. A periodic table group 15 element, typically phosphorus (P) or arsenic (As) is used as the impurity element which imparts n-type conductivity, and phosphorus (P) is used here. The conductive layers 417 to 420 become masks with respect to the n-type conductivity imparting impurity element in this case, and first impurity regions 423 to 426 are formed in a self-aligning manner. The impurity element which imparts n-type conductivity is added to the first impurity regions 423 to 426 with a concentration in the range of $1\times10^{20}$ to $1\times10^{21}$ atoms/cm$^3$.

A second etching process is performed next, as shown in FIG. 8C. The ICP etching method is similarly used. A plasma is generated by introducing a reaction gas to a chamber and a supplying a predetermined RF electric power (13.56 MHz) to a coil shape electrode. Low RF electric power (13.56 MHz) is applied to the substrate side (test piece stage), and a self-bias voltage which is lower in comparison to that of the first etching process is applied. The W film is etched anisotropically forming second shape conductive layers 427 to 432.

A second doping process is then performed, as shown in FIG. 8C. The dose amount is made smaller than that of the first doping process in this case, and an impurity element which imparts n-type conductivity is doped under high acceleration voltage conditions. For example, doping is performed with the acceleration voltage set from 70 to 120 keV, and a dose amount of $1\times10^{13}$ atoms/cm$^2$, and a new impurity region is formed inside the first impurity region formed in the island shape semiconductor layers of FIG. 8B. The second conductive layers 427 to 430 are used as masks with respect to the impurity element, and doping is performed so as to also add the impurity element into regions under the first conductive layers 427*a* to 430*a*. Second impurity regions 433 to 437 that overlap the first conductive layers 427*a* to 430*a*. The impurity element which imparts n-type conductivity is added such that the concentration becomes from $1\times10^{17}$ to $1\times10^{18}$ atoms/cm$^3$ in the second impurity regions.

Figures 9A, 9B, 9C:
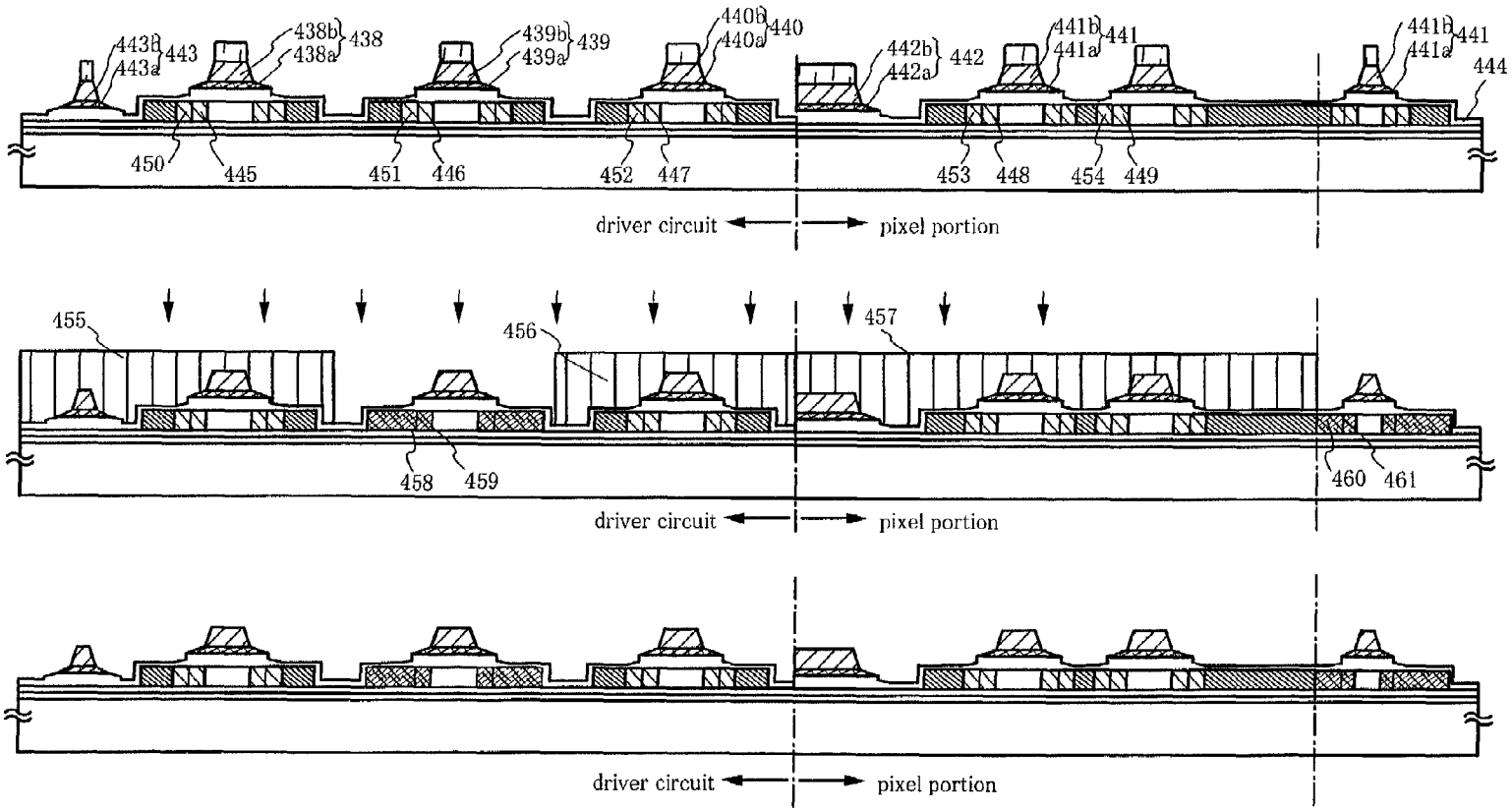
FIGS. 9A to 9C are cross-sectional views illustrating a method of manufacturing an active matrix substrate.

As shown in FIG. 9A, the first conductive layer, TaN, is backward and also etched by etching the gate insulating film 416. Third shape conductive layers 438 to 443 (first conductive layers 438*a* to 443*a* and second conductive layers 438*b* to 443*b*) are formed. Reference numeral 444 denotes a gate insulating film, and the regions not covered by the third shape conductive layers 438 to 443 are made thinner by etching of about 20 to 50 nm.

In FIG. 9A, third impurity region 445 to 449 which is overlapped with the conductive layers 438*a* to 441*a* and fourth impurity region 450 to 454 which is outside the third impurity region. Therefore the concentration of an impurity element which imparts n-type conductivity into third impurity region and fourth impurity region is equal to an impurity element in second impurity region approximately.

Forth impurity regions 458 to 461 having a conductivity type which is the opposite of the above conductive type impurity element, are then formed as shown in FIG. 9B in the island shape semiconductor layers 403 and 406 which form p-channel TFTs. Third shape conductive layers 439 and 441 is used as a mask with respect to the impurity element, and the impurity regions are formed in a self-aligning manner. The island shape semiconductor layers 402, 404 and 405, which form n-channel TFTs, are covered over their entire surface areas by resist masks 455 to 457. Phosphorus is added to the impurity regions 458 to 461 at a different concentration, and ion doping is performed here using diborane ($B_2H_6$), so that the respective impurity regions have the impurity concentration of $2\times10^{20}$ to $2\times10^{21}$ atoms/$cm^3$.

Impurity regions are formed in the respective island shape semiconductor layers by the above processes. The conductive layers (which forms conductive layers) 438 to 441 overlapping the island shape semiconductor layer function as gate electrodes of TFT. Further, reference numeral 442 functions as a source wiring and 443 functions as a wiring inside the driver circuit.

A process of activating the impurity elements added to the respective island shape semiconductor layers is then performed, as shown in FIG. 9C, with the aim of controlling conductivity type. Thermal annealing using an annealing furnace is performed for this process. In addition, laser annealing and rapid thermal annealing (RTA) can also be applied. Thermal annealing is performed with an oxygen concentration equal to or less than 1 ppm, preferably equal to or less than 0.1 ppm, in a nitrogen atmosphere at 400 to 700° C., typically between 500 and 600° C. Heat treatment is performed for 4 hours at 500° C. in Embodiment 1. However, for cases in which the wiring material used in the wirings 438 to 443 is weak with respect to heat, it is preferable to perform activation after forming an interlayer insulating film (having silicon as its main constituent) in order to protect the wirings and the like.

In addition, heat treatment is performed for 1 to 12 hours at 300 to 450° C. in an atmosphere containing between 3 and 100% hydrogen, performing hydrogenation of the island shape semiconductor layers. This process is one of terminating dangling bonds in the island shape semiconductor layers by hydrogen which is thermally excited. Plasma hydrogenation (using hydrogen excited by a plasma) may also be performed as another means of hydrogenation.

Figure 10:
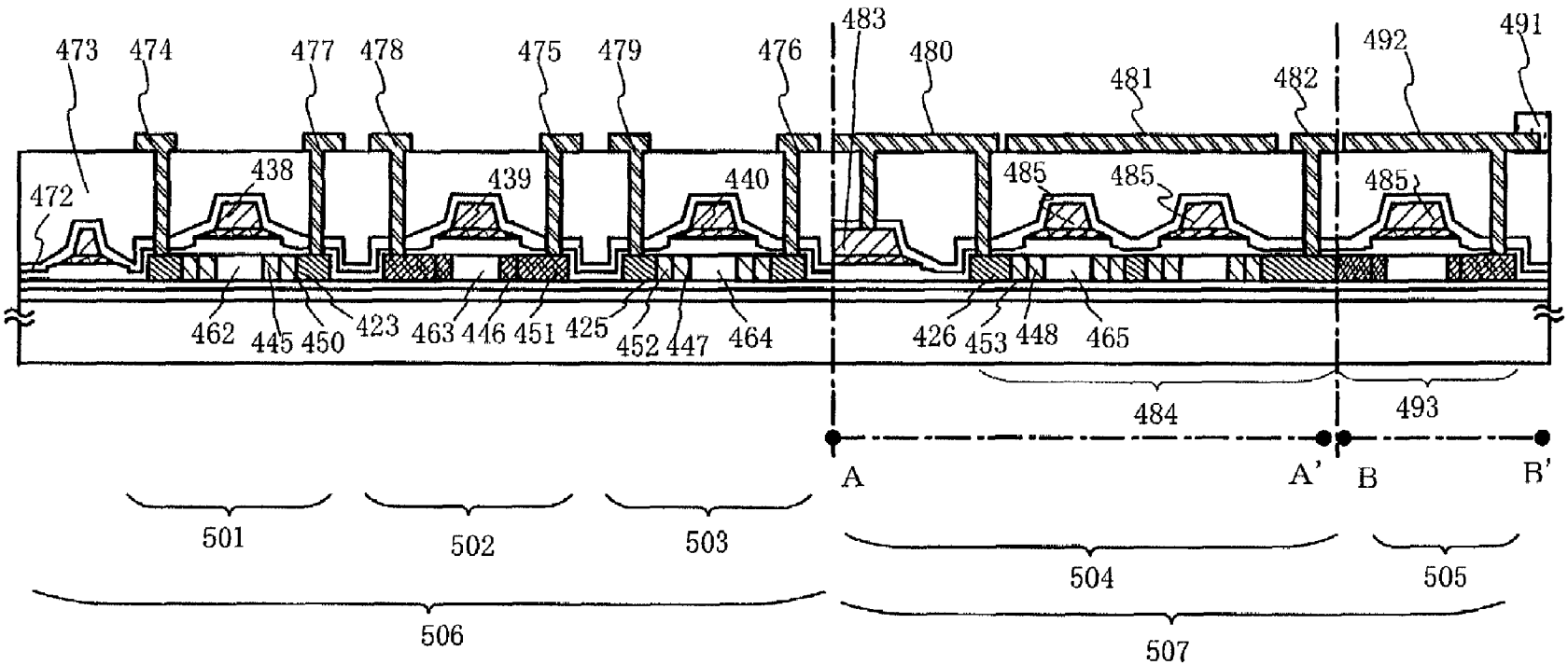
FIG. 10 is a cross-sectional view illustrating a method of manufacturing an active matrix substrate.

A first interlayer insulating film 472 is formed next of a silicon oxynitride film having a thickness of 100 to 200 nm as FIG. 10. An acrylic resin film or a polyimide resin film is formed to 1.8 μm thick as a second interlayer insulating film 473 made of an organic insulating material on the first interlayer insulating film 472. Etching is then performed in order to form contact holes.

Next, a conductive metal film is formed by a sputtering method or a vacuum evaporation method. That is, first, a Ti film is formed to have a thickness of 50 to 150 nm. A contact is formed between the Ti film and a semiconductor film composing a source region or a drain region of an island-like semiconductor film. Aluminum (Al) is formed to have a thickness of 300 to 400 nm on the Ti film, and then a Ti film or a titanium nitride (TiN) film is formed to have a thickness of 100 to 200 nm. Thus, a three layered structure is obtained.

Then, in the driver circuit portion, source wirings 474 to 476 for contact with the source regions of the island-like semiconductor films and drain wirings 477 to 479 for contact with the drain regions thereof are formed.

In addition, in the pixel portion, the connection electrode 480, the gate wiring 481, the drain electrode 482, and the second electrode 492 are formed.

The connection electrode 480 is electrically connected with the source wiring 483 and the first semiconductor film 484. Although not shown, the gate wiring 481 is electrically connected with the first electrode 485 through the contact hole. The drain electrode 482 is electrically connected with the drain region of the first semiconductor film 484. The second electrode 492 is electrically connected with the second semiconductor film 493, and thus the second semiconductor film 493 functions as the electrode of the retaining capacitor 505.

After that, a transparent conductive film is formed on the entire surface and the pixel electrode 491 is formed by patterning and etching using a photo mask. The pixel electrode 491 is formed on the second interlayer insulating film 473 and a portion overlapped with the drain electrode 482 of the pixel TFT and the second electrode 492 is provided in the pixel electrode 491. Thus, a connection structure is formed.

As a material of the transparent conductive film, indium oxide ($In_2O_3$), an alloy of indium oxide and tin oxide ($In_2O_3$—$SnO_2$:ITO), or the like can be used. The transparent conductive film is formed using the above material by a sputtering method, a vacuum evaporation method, or the like. Such a material is etched using a hydrochloric acid system solution. However, in particular, etching of the ITO is easy to cause the residue. Thus, in order to improve processing by etching, an alloy of indium oxide and zinc oxide ($In_2O_3$—ZnO) may be used. The alloy of indium oxide and zinc oxide has superior surface smoothness and thermal stability superior to the ITO. Thus, corrosion reaction to Al in contact with edges of the drain electrode 482 can be prevented. Similarly, zinc oxide (ZnO) is a suitable material and in order to further improve transmittance of visual light and conductivity, zinc oxide (ZnO:Ga) to which gallium (Ga) is added, or the like can be used.

Thus, the active matrix substrate corresponding to the transmission liquid crystal display device can be completed.

By the above processes, the driver circuit portion having an n-channel TFT 501, a p-channel TFT 502, and an n-channel TFT 503, and the pixel portion having a pixel TFT 504 and the retaining capacitor 505 can be formed on the same substrate. In this specification, such a substrate is called an active matrix substrate for convenience.

The n-channel TFT 501 in the driver circuit portion has a channel forming region 462, third impurity regions 445 (GOLD regions) overlapped with a conductive layer 438 composing the gate electrode, fourth impurity regions 450 (LDD regions) formed outside the gate electrode, and first impurity regions 423 which function as the source region or the drain region. The p-channel TFT 502 has a channel forming region 463, fifth impurity regions 446 overlapped with a conductive layer 439 composing the gate electrode, and sixth impurity regions 451 which function as the source region or the drain region. The n-channel TFT 503 has a channel forming region 464, third impurity regions 447 (GOLD regions) overlapped with a conductive layer 440 composing the gate electrode, fourth impurity regions 452 (LDD regions) formed outside the gate electrode, and first impurity regions 425 which function as the source region or the drain region.

The pixel TFT 504 in the pixel portion has a channel forming region 465, third impurity regions 448 (GOLD region) overlapped with the conductive layer 485 forming a gate electrode, fourth impurity regions 453 (LDD region) formed outside the gate electrode, and first impurity regions 426 which function as the source region or the drain region. In addition, an impurity element for providing a p-type is added to the semiconductor film 493 which functions as one electrode of the retaining capacitor 505. The retaining capacitor is constructed by the conductive layer 485 forming a gate electrode and an insulating layer located therebetween (the same layer as the gate insulating film).

Figure 11:
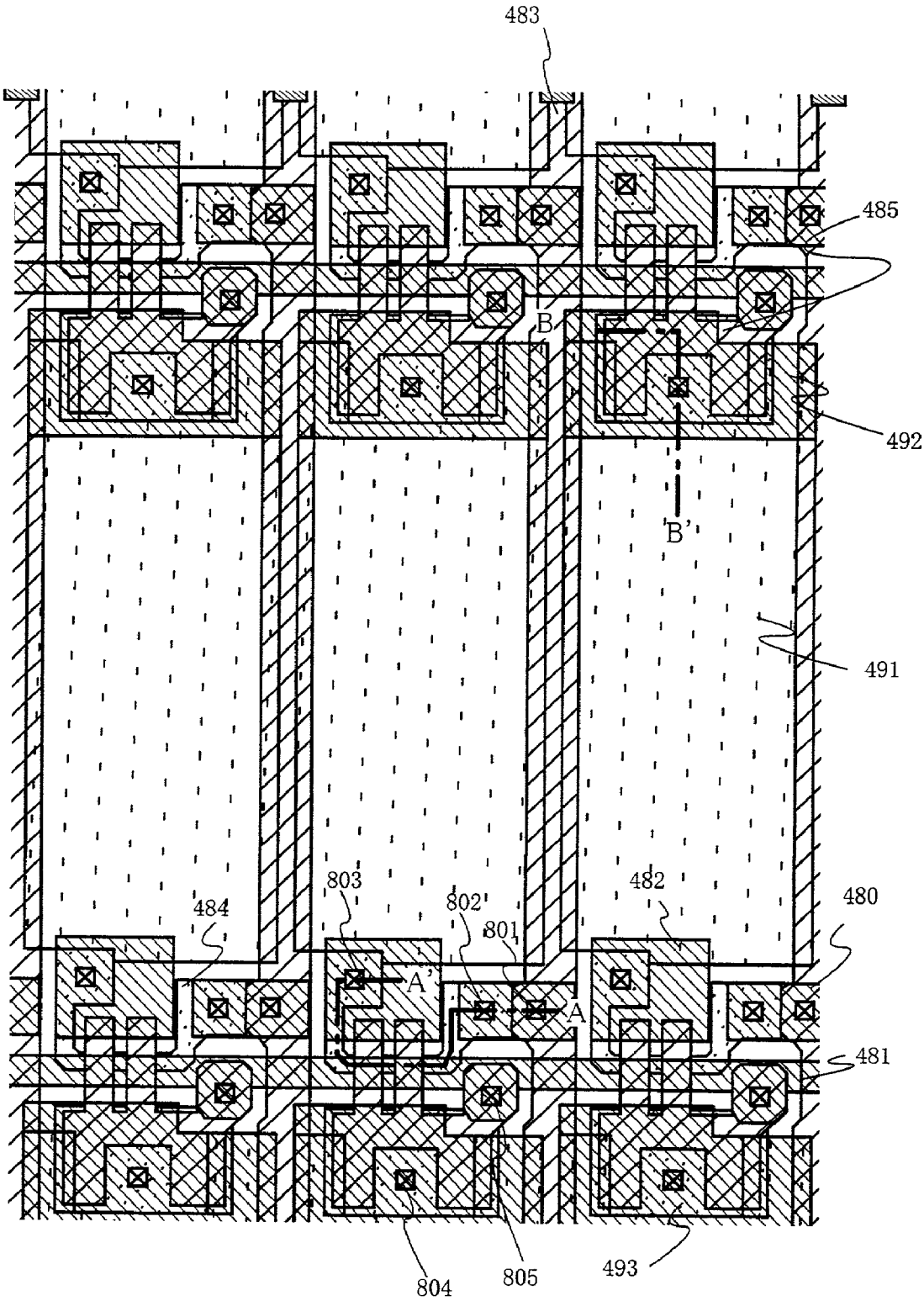
FIG. 11 is a plan view showing a pixel portion of an active matrix substrate.

Cross sectional view obtained by cutting along dashed lines A-A' and B-B' of top view of FIG. 11 correspond to the cross-sectional view obtained by cutting along dashed lines A-A' and B-B' of FIG. 10. The references numeral 801 to 805 in FIG. 11 shows a contact hole.

By the drain electrode making have a function as a conductive film with a reflectivity and also a pixel electrode, an active matrix substrate of a reflection type liquid crystal display device can thus be formed.

Embodiment 2

Figure 12:
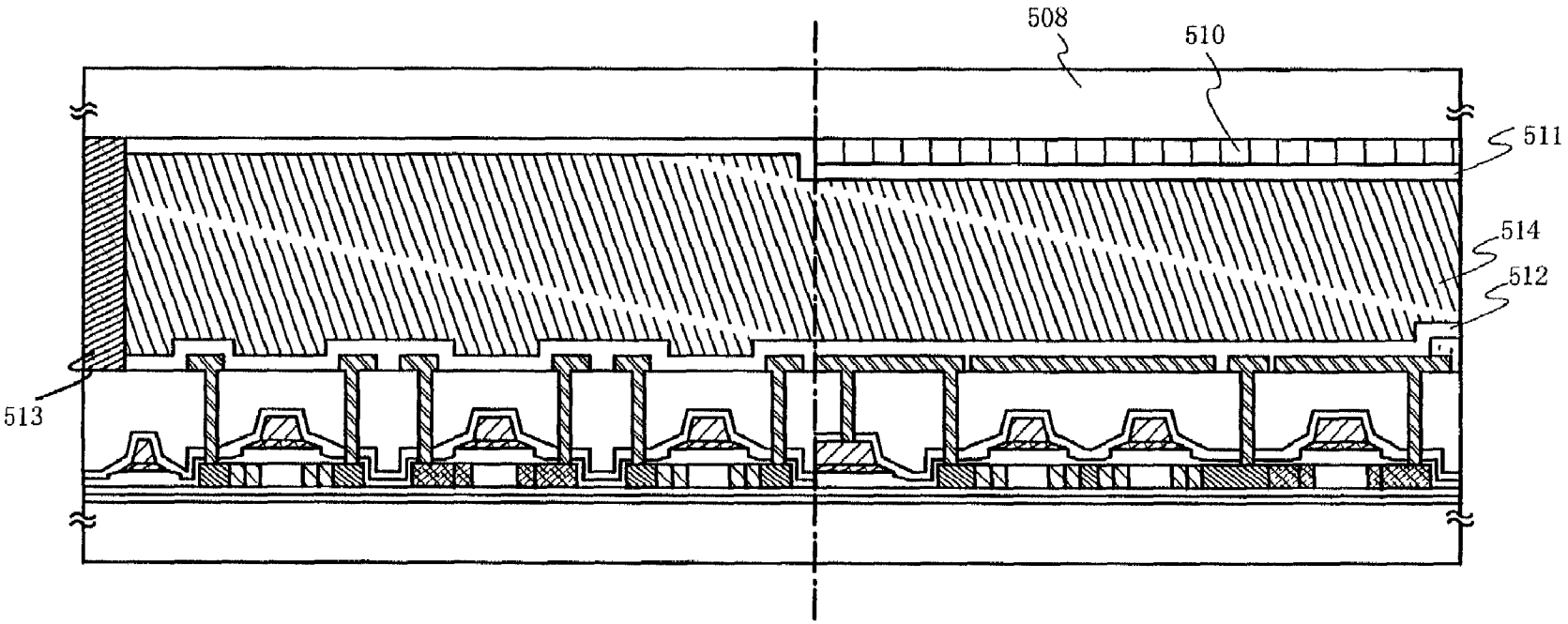
FIG. 12 is a cross-sectional view of a liquid crystal display device.

In Embodiment 2, a method of manufacturing a liquid crystal display device used for the field sequential system will be exemplified. FIG. 12 shows a liquid crystal display device using TFT elements as switching elements.

A light-blocking film (not shown) is formed on a counter substrate 508. The light-blocking film can be made of chromium (Cr) or the like. The thickness of the light-blocking film is preferably in a range of 100 nm to 200 nm. The light-blocking film is formed in a region where alignment failure occurs, thereby preventing a contrast from decreasing due to the alignment failure of liquid crystal.

A transparent conductive film 510 is formed on the light-blocking film. The transparent conductive film 510 can be made of an indium tin oxide (ITO) film. In order to keep a high transmittance of visible light, the thickness of the ITO film is preferably in a range of 100 nm to 120 nm.

Alignment films 511 and 512 are formed on an active matrix substrate and the counter substrate 508, respectively. The thickness of the alignment film is preferably in a range of 30 nm to 80 nm. As the alignment film, for example, SE7792 produced by Nissan Kagaku Co., Ltd. can be used. When an alignment film with a high pretilt is used, disclination can be suppressed when a liquid crystal display device is driven by the active matrix system.

The alignment films 511 and 512 are subjected to rubbing.

Although not shown, spacers may be scattered or patterned in pixels so as to enhance uniformity of a cell gap. In the present embodiment, in order to increase a response speed of liquid crystal, the height of a spacer is prescribed to be 1.0 μm, and an electric field intensity for driving liquid crystal is increased.

The counter substrate and the active matrix substrate are attached to each other with a sealant 513. The counter substrate and the active matrix substrate are attached to each other in such a manner that the rubbing directions of the alignment films formed on these substrates are orthogonal to each other. A UV-curable sealant XNR 5610-1H1 produced by Mitsui Toatsu K.K. is used. Silica spacers produced by Shokubai Kagaku Kogyo Co., Ltd. are mixed in the sealant. The diameter of the silica spacer is set to be 1.0 μm. After the sealant is cured, the counter substrate and the active substrate are separated.

A liquid crystal material 514 is injected. A liquid crystal material with a low viscosity is preferable in terms of a high-speed response. In the present embodiment, nematic liquid crystal that is easy to control alignment is used and a chiral material added thereto, whereby twisted nematic (TN) alignment is conducted. It is also appreciated that ferroelectric liquid crystal and antiferroelectric liquid crystal capable of conducting a high-speed response may be used. According to the present invention, regarding ferroelectric liquid crystal and antiferroelectric liquid crystal, liquid crystal capable of displaying an analog gray-scale is preferably selected. A material may also be used, which is obtained by adding polymer resin to ferroelectric liquid crystal or anti ferroelectric liquid crystal, followed by curing a mixture thereof by irradiation with light. An alignment method of adding polymer resin to ferroelectric liquid crystal or antiferroelectric liquid crystal is called a polymer stabilization method.

After confirming that the liquid crystal material is injected, an injection port is sealed with a UV-curable sealing agent.

Then, polarizing plates (not show) are attached by a known technique. Thus, a liquid crystal display device is completed.

Embodiment 3

The liquid crystal display device manufactured by implementing either of the Embodiments 1 of 2 can be used to various electro-optical devices. Namely, the present invention can be implemented into all of the electronic devices that incorporate such electro-optical devices as a display portion.

Following can be given as such electronic devices: video cameras; digital cameras; head mounted displays (goggle type displays); car navigation systems; car stereo; personal computers; portable information terminals (mobile computers, portable telephones or electronic books etc.) etc. Examples of these are shown in FIGS. 13 and 14.

Figure 13A:
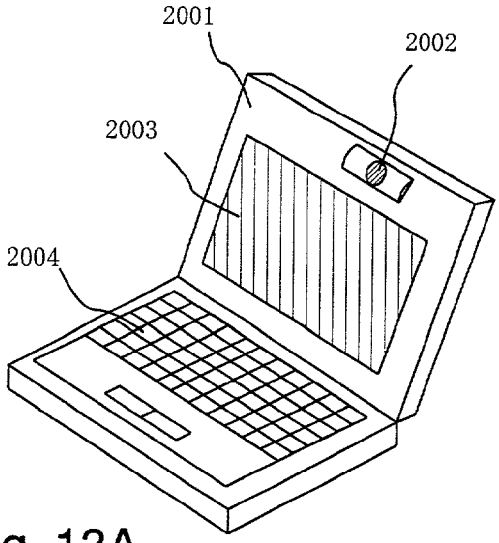
FIGS. 13A to 13F show examples of electronic equipment.

FIG. 13A is a personal computer which comprises: a main body 2001; an image input section 2002; a display section 2003; and a key board 2004. The present invention can be applied to the display section 2003.

Figure 13B:
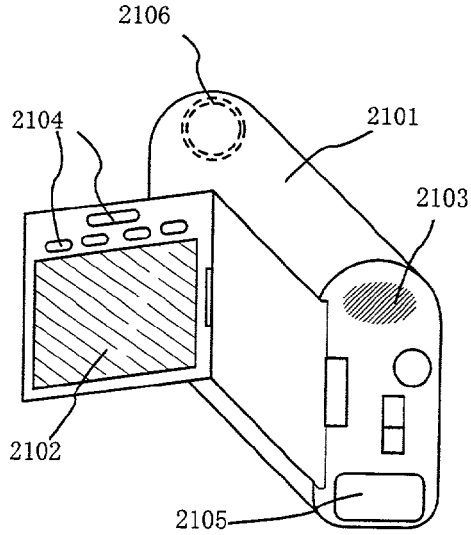

FIG. 13B is a video camera which comprises: a main body 2101; a display section 2102; a voice input section 2103; operation switches 2104; a battery 2105 and an image receiving section 2106. The present invention can be applied to the display section 2102.

Figure 13C:
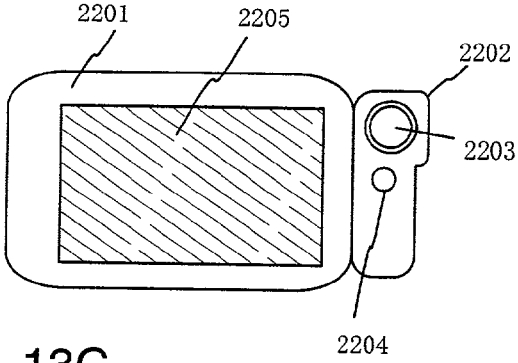

FIG. 13C is a mobile computer which comprises: a main body 2201; a camera section 2202; an image receiving section 2203; operation switches 2204 and a display section 2205. The present invention can be applied to the display section 2205.

Figure 13D:
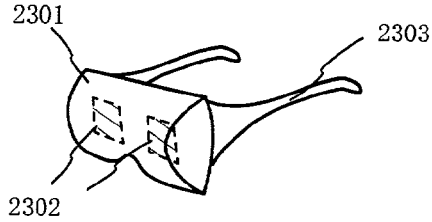

FIG. 13D is a goggle type display which comprises: a main body 2301; a display section 2302; and an arm section 2303. The present invention can be applied to the display section 2302.

Figure 13E:
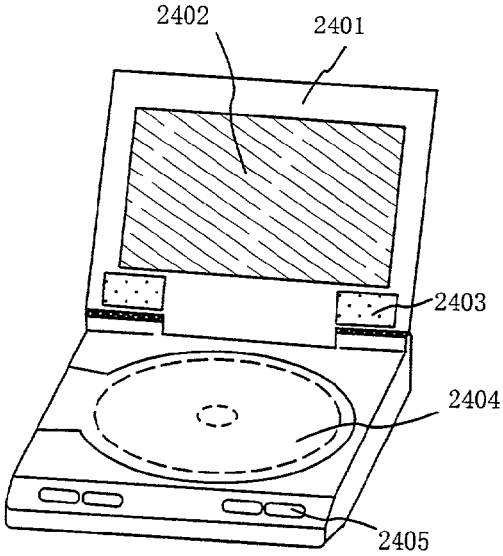
Figure 13F:
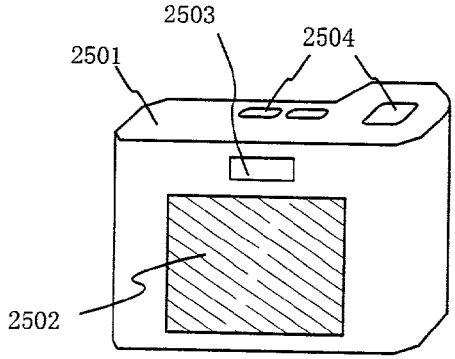

FIG. 13E is a player using a recording medium which records a program (hereinafter referred to as a recording medium) which comprises: a main body 2401; a display section 2402; a speaker section 2403; a recording medium 2404; and operation switches 2405. This device uses DVD (digital versatile disc), CD, etc. for the recording medium, and can perform music appreciation, film appreciation, games and the use for Internet. The present invention can be applied to the display section 2402. FIG. 13F is a digital camera which comprises: a main body 2501; a display portion 2502; a view finder 2503; operation switches 2504; and an image receiving section (not shown in the figure). The present invention can be applied to the display section 2502.

Figure 14A:
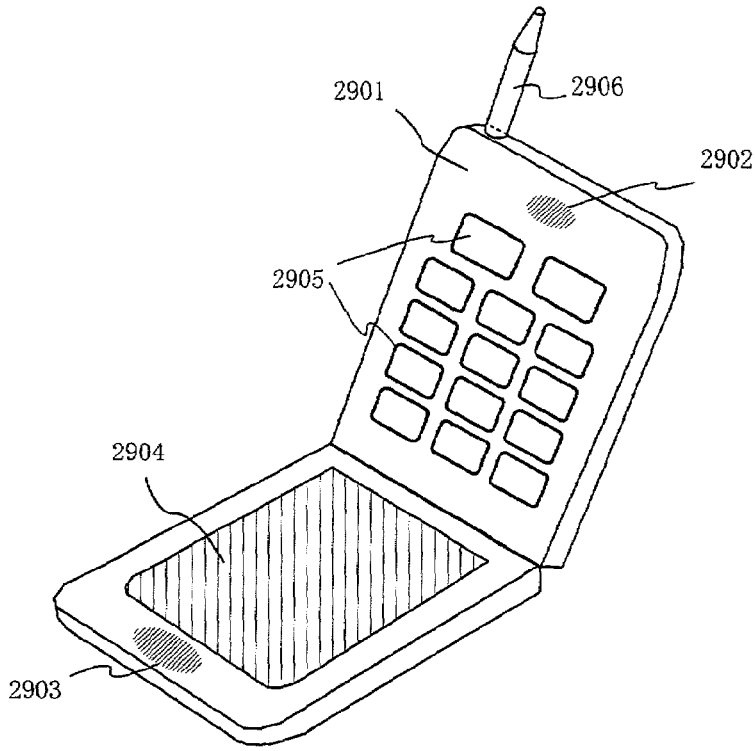
FIGS. 14A to 14C show examples of electronic equipment.

FIG. 14A is a portable telephone which comprises: a main body 2901; a voice output section 2902; a voice input section 2903; a display section 2904; operation switches 2905; and an antenna 2906 etc. The present invention can be applied to the display section 2904.

Figure 14B:
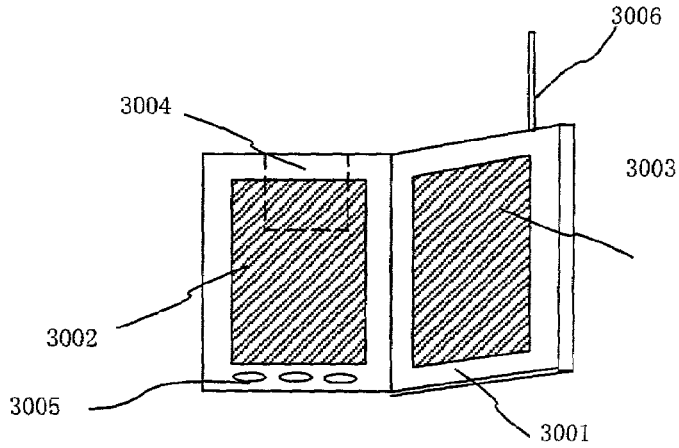

FIG. 14B is a portable book (electronic book) which comprises: a main body 3001; display sections 3002 and 3003; a recording medium 3004; operation switches 3005 and an antenna 3006 etc. The present invention can be applied to the display sections 3002 and 3003.

Figure 14C:
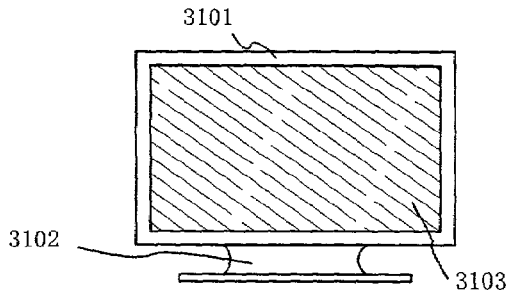

FIG. 14C is a display which comprises: a main body 3101; a supporting section 3102; and a display section 3103 etc. The present invention can be applied to the display section 3103.

As described above, the applicable range of the present invention is very large, and the invention can be applied to electronic devices of various areas. Note that the electronic devices of the present embodiment can be achieved by utilizing any combination of constitutions in Embodiments 1 to 2.

As described above, according to the present invention, a response time of liquid crystal and a write time of pixel data can be shortened in the field sequential system. Because of this, a light display with a long and light lighting period of a light source can be obtained.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A method of driving a liquid crystal display device comprising a first to n-th pixels (n is a natural number and n≧2), wherein first to n-th signal voltages are to be applied to first to n-th pixel electrodes of the first to n-th pixels respectively in a first sub-frame period, wherein (n+1)-th to 2n-th signal voltages are to be applied to the first to n-th pixel electrodes respectively in a second sub-frame period, wherein response periods of liquid crystal of the first to n-th pixels from when the first to n-th signal voltages are applied to when the (n+1)-th to 2n-th signal voltages are applied respectively are calculated, and wherein in an order of the calculated response periods of liquid crystal of the first to n-th pixels from longest to shortest, the (n+1)-th to 2n-th signal voltages are applied to the first to n-th pixel electrodes in the second sub-frame period.

2. A method of driving a liquid crystal display device according to claim 1, wherein a first light emission color, a second light emission color, and a third light emission color are intermittently incident upon the liquid crystal display device.

3. A method of driving a liquid crystal display device according to claim 1, wherein the liquid crystal display device is driven in a field sequential system.

4. A method of driving a liquid crystal display device, wherein the liquid crystal display device comprises:

a signal line;

a first scanning line;

a second scanning line;

a first thin film transistor connected to the signal line and the first scanning line;

a first pixel electrode connected to the first thin film transistor;

a second thin film transistor connected to the signal line and the second scanning line; and a second pixel electrode connected to the second thin film transistor, wherein the method comprises the steps of:

applying a first signal voltage to the first and second pixel electrodes; and applying a second signal voltage to the second pixel electrode, wherein a difference between an absolute value of the first signal voltage and the second signal voltage is larger than 0 volt and smaller than 0.5 volt.

5. A method of driving a liquid crystal display device according to claim 4, wherein a first light emission color, a second light emission color, and a third light emission color are intermittently incident upon the liquid crystal display device.

6. A method of driving a liquid crystal display device according to claim 4, wherein the liquid crystal display device is driven in a field sequential system.

7. A liquid crystal display device, comprising:

a first to n-th pixels (n is a natural number and n≧2);

a means for storing first to n-th signal voltages to be applied to first to n-th pixel electrodes of the first to n-th pixels respectively in a first sub-frame period;

a means for storing (n+1)-th to 2n-th signal voltages to be applied to the first to n-th pixel electrodes of the first to n-th pixels respectively in a second sub-frame period;

a means for calculating response periods of liquid crystal of the first to n-th pixels from when the first to n-th signal voltages are applied to when the (n+1)-th to 2n-th signal voltages are applied respectively; and a means for applying the (n+1)-th to 2n-th signal voltages to the first to n-th pixel electrodes respectively in an order of the calculated response periods of liquid crystal of the first to n-th pixels from longest to shortest.

8. A liquid crystal display device according to claim 7, further comprising:

a means for selecting a signal line connected to one of first to n-th pixel TFTs (n is a natural number and n≧2) in the first to n-th pixels; and a means for selecting a scanning line connected to the one of the first to n-th pixel TFTs in the first to n-th pixels.

9. A liquid crystal display device according to claim 8, wherein the means for selecting a signal line has an address decoder.

10. A liquid crystal display device according to claim 8, wherein the means for selecting a scanning line has an address decoder.

11. A liquid crystal display device, wherein light sources of a liquid crystal display device according to claim 7 are composed of a light source of a first light emission color, a light source of a second light emission color, and a light source of a third light emission color.

12. A method of driving a liquid crystal display device,
wherein the liquid crystal display device comprises:
first to n-th pixels (n is a natural number and n≧2);
first to n-th pixel electrodes included in the first to n-th pixels respectively,
wherein the method comprises:
applying first to n-th signal voltages to the first to n-th pixel electrodes respectively in a first sub-frame period;
applying (n+1)-th to 2n-th signal voltages to the first to n-th pixel electrodes respectively in a second sub-frame period
deciding an order of applying the (n+1)-th to 2n-th signal voltages to the first to n-th pixel electrodes in accordance with voltage differences between the first to n-th signal voltages and the (n+1)-th to 2n-th signal voltages respectively.

13. A method of driving a liquid crystal display device according to claim 12, wherein the liquid crystal display device is driven in a field sequential system.

14. A method of driving a liquid crystal display device,
wherein the liquid crystal display device comprises:
first to n-th pixels (n is a natural number and n≧2);
first to n-th pixel electrodes included in the first to n-th pixels respectively,
wherein the method comprises:
applying first to n-th signal voltages to the first to n-th pixel electrodes respectively in a first sub-frame period;
applying (n+1)-th to 2n-th signal voltages to the first to n-th pixel electrodes respectively in a second sub-frame period
deciding an order of applying the (n+1)-th to 2n-th signal voltages to the first to n-th pixel electrodes in accordance with voltage differences between the first to n-th signal voltages and the (n+1)-th to 2n-th signal voltages respectively, so that the (n+1)-th to 2n-th signal voltages are applied to the first to n-th pixel electrodes in an order of the voltage differences from longest to shortest.

15. A method of driving a liquid crystal display device according to claim 14, wherein the liquid crystal display device is driven in a field sequential system.

16. A method of driving a liquid crystal display device,
wherein the liquid crystal display device comprises:
first to n-th pixels (n is a natural number and n≧2);
first to n-th pixel electrodes included in the first to n-th pixels,
a first storage means; and
a second storage means,
wherein the method comprising comprises:
applying first to n-th signal voltages to the first to n-th pixel electrodes in a first sub-frame period;
storing the first to n-th signal voltages in the first storage means;
storing (n+1)-th to 2n-th signal voltages in the second storage means;
comparing the first to n-th signal voltages and the (n+1)-th to 2n-th signal voltages respectively, thereby obtaining voltage differences between the first to n-th signal voltages and the (n+1)-th to 2n-th signal voltages respectively;
applying the (n+1)-th to 2n-th signal voltages to the first to n-th pixel electrodes respectively in a second sub-frame period;
deciding an order of applying the (n+1)-th to 2n-th signal voltages to the first to n-th pixel electrodes respectively in accordance with the voltage differences.

17. A method of driving a liquid crystal display device according to claim 16, wherein the liquid crystal display device is driven in a field sequential system.

18. A method of driving a liquid crystal display device,
wherein the liquid crystal display device comprises:
first to n-th pixels (n is a natural number and n≧2);
first to n-th pixel electrodes included in the first to n-th pixels, a first storage means; and
a second storage means,
wherein the method comprising comprises:
applying first to n-th signal voltages to the first to n-th pixel electrodes in a first sub-frame period;
storing the first to n-th signal voltages in the first storage means;
storing (n+1)-th to 2n-th signal voltages in the second storage means;
comparing the first to n-th signal voltage and the (n+1)-th to 2n-th signal voltages respectively, thereby obtaining voltage differences between the first to n-th signal voltages and the (n+1)-th to 2n-th signal voltages respectively;
applying the (n+1)-th to 2n-th signal voltages to the first to n-th pixel electrodes respectively in a second sub-frame period;
deciding an order of applying the (n+1)-th to 2n-th signal voltages to the first to n-th pixel electrodes respectively in accordance with the voltage differences, so that the (n+1)-th to 2n-th signal voltages are applied to the first to n-th pixel electrodes in an order of the voltage differences from longest to shortest.

19. A method of driving a liquid crystal display device according to claim 18, wherein the liquid crystal display device is driven in a field sequential system.

* * * * *